US009506689B2

(12) United States Patent
Carbajal et al.

(10) Patent No.: US 9,506,689 B2
(45) Date of Patent: Nov. 29, 2016

(54) PIVOTING MULLION FOR A TEMPERATURE-CONTROLLED STORAGE DEVICE

(71) Applicant: Anthony International, Sylmar, CA (US)

(72) Inventors: Frank J. Carbajal, La Crescenta, CA (US); Paul J. Artwohl, Stevensville, MI (US); Jeffery W. Nicholson, Palmdale, CA (US)

(73) Assignee: Anthony International, Sylmar, CA (US)

( * ) Notice: Subject to any disclaimer, the term of this patent is extended or adjusted under 35 U.S.C. 154(b) by 217 days.

(21) Appl. No.: 14/328,181

(22) Filed: Jul. 10, 2014

(65) Prior Publication Data

US 2015/0015133 A1 Jan. 15, 2015

Related U.S. Application Data

(60) Provisional application No. 61/845,234, filed on Jul. 11, 2013.

(51) Int. Cl.

| | |
|---|---|
| ***F25D 23/02*** | (2006.01) |
| ***F25D 27/00*** | (2006.01) |
| ***A47F 3/04*** | (2006.01) |

(Continued)

(52) U.S. Cl.

CPC ..... *F25D 27/00* (2013.01); *A47F 3/04* (2013.01); *A47F 3/043* (2013.01); *E06B 7/20* (2013.01); *E06B 7/28* (2013.01); *F25D 11/00* (2013.01); *F25D 23/02* (2013.01); *F25D 23/028* (2013.01)

(58) Field of Classification Search

CPC ..... A47F 3/04; A47F 3/043; E06B 7/20; E06B 7/28; F25D 23/02; F25D 23/028; F25D 27/00; A47B 96/04

See application file for complete search history.

(56) References Cited

U.S. PATENT DOCUMENTS

| | | | | |
|---|---|---|---|---|
| 4,711,098 | A | 12/1987 | Kuwabara et al. | |
| 7,008,032 | B2 * | 3/2006 | Chekal | F25D 11/02 312/405 |

(Continued)

FOREIGN PATENT DOCUMENTS

| | | |
|---|---|---|
| KR | 20130052087 | 5/2013 |
| WO | WO-2012/084498 | 6/2012 |

OTHER PUBLICATIONS

Extended European Search Report for European Patent Application No. 14176533.9, dated Nov. 20, 2014, 10 pages.

*Primary Examiner* — Peggy Neils
(74) *Attorney, Agent, or Firm* — Foley & Lardner LLP

(57) ABSTRACT

A pivoting mullion for a temperature-controlled storage device is provided. The pivoting mullion includes a mullion body pivotally attached to a display case door of the temperature-controlled storage device. The mullion body is rotatable relative to the display case door between a first position when the display case door is open and a second position when the display case door is closed. The mullion body is configured to provide a support surface against which the display case door rests when the mullion body is in the second position and the display case door is closed. The pivoting mullion further includes a lighting element fixed to the mullion body and configured to activate when the display case door is closed. Activation of the lighting element illuminates items within the temperature-controlled storage device such that the items are visible through the display case door when the display case door is closed.

30 Claims, 28 Drawing Sheets

(51) Int. Cl.

| | |
|---|---|
| ***E06B 7/20*** | (2006.01) |
| ***E06B 7/28*** | (2006.01) |
| ***F25D 11/00*** | (2006.01) |

(56) References Cited

U.S. PATENT DOCUMENTS 9,157,676 B2 * 10/2015 Lee ..... F25D 23/028
9,163,870 B2 * 10/2015 Jeon ..... F25D 23/00
2001/0003408 A1 * 6/2001 Otto ..... A47F 3/043 312/407
2009/0113927 A1 * 5/2009 Laible ..... E05B 65/0042 62/449
2009/0273264 A1 * 11/2009 Butler ..... F25D 23/028 312/405
2014/0268648 A1 * 9/2014 Gomes ..... F25D 27/005 362/94

* cited by examiner

PIVOTING MULLION FOR A TEMPERATURE-CONTROLLED STORAGE DEVICE

CROSS-REFERENCE TO RELATED PATENT APPLICATIONS

This application claims the benefit of and priority to U.S. Provisional Patent Application No. 61/845,234 filed Jul. 11, 2013, the entirety of which is incorporated by reference herein.

BACKGROUND

The present disclosure relates generally to the field of temperature-controlled storage devices such as refrigerators, freezers, refrigerated display cases and the like. The present disclosure relates more particularly to a pivoting mullion for a temperature-controlled storage device.

A mullion is a vertical bar dividing a door opening, window, or other opening into two smaller openings (e.g., a left-side opening and a right-side opening). Traditionally, mullions have been used with French-style doors (e.g., doors that are hingedly connected to opposite sides of a door opening) to create a central support surface against which the doors can rest in a sealed fashion when the doors are in a closed position.

Typical mullions are fixed within the opening (i.e., stationary) and cannot be easily moved or removed. Stationary mullions permanently divide an opening of a temperature-controlled storage device into two smaller openings, thereby limiting the size and shape of items that can be transported through the opening and reducing accessibility to the interior of the temperature-controlled storage device.

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

SUMMARY

One implementation of the present disclosure is a pivoting mullion for a temperature-controlled storage device. The pivoting mullion includes a mullion body pivotally attached to a display case door of the temperature-controlled storage device, the display case door having a substantially transparent surface. The mullion body is rotatable relative to the display case door between a first position when the display case door is open and a second position when the display case door is closed. The mullion body is configured to provide a support surface against which the display case door rests when the mullion body is in the second position and the display case door is closed. The pivoting mullion further includes a lighting element fixed to the mullion body. The lighting element is configured to activate when the display case door is closed. Activation of the lighting element illuminates items within the temperature-controlled storage device such that the items are visible through the substantially transparent surface of the display case door when the display case door is closed.

In some embodiments, the pivoting mullion further includes a cam extending from the mullion body and a cam guide attached to a frame of the display case door. The cam guide is configured to engage the cam when the display case door is moved toward a closed position. Engaging the cam causes the mullion body to rotate toward the second position. In some embodiments, the cam guide is configured to engage the cam throughout an engagement range. The engagement range is a portion of a complete rotational range of the display case door.

In some embodiments, the pivoting mullion further includes a hinge fixedly attached to the display case door. The hinge includes a transverse portion extending substantially horizontally away from the display case door and a pin extending substantially vertically from the transverse portion. The pin defines an axis of rotation within the mullion body about which the mullion body rotates between the first position and the second position.

In some embodiments, the mullion body is substantially rectangular comprising a first face and a second face substantially perpendicular to the first face. The first face and the second face share an edge. In some embodiments, the mullion body includes a continuous opening spanning a portion of the first face, a portion of the shared edge, and a portion of the second face. In some embodiments, the transverse portion of the hinge extends through the portion of the opening in the first face when the mullion body is in the first position, and through the portion of the opening in the second face when the mullion body is in the second position.

Another implementation of the present disclosure is another pivoting mullion for a temperature-controlled storage device. The pivoting mullion includes a mullion body pivotally attached to a door of the temperature-controlled storage device. The mullion body is configured to rotate between a first position and a second position relative to the door. The mullion body is configured to provide a support surface against which the door rests when the mullion body is in the second position and the door is closed. The pivoting mullion further includes a magnetic coupling configured to bias the mullion body toward the first position and to hold the mullion body in the first position when the door is open.

In some embodiments, the magnetic coupling includes a hinge fixedly attached to the door and an insert fixed to the mullion body. At least one of the hinge and the insert comprises a magnet housed therein. The magnet is configured to apply a magnetic force between the hinge and the insert. The magnetic force biases the mullion body toward the first position and holds the mullion body in the first position when the door is open.

In some embodiments, the door is a display case door for a temperature-controlled display case. In some embodiments, the mullion body rotates approximately 90 degrees between the first position and the second position.

Another implementation of the present disclosure is yet another pivoting mullion for a temperature-controlled storage device. The pivoting mullion includes a mullion body comprising an extruded shell and an insulating foam core within the extruded shell. The mullion body is pivotally attached to a door of the temperature-controlled storage device and configured to rotate between a first position and a second position relative to the door. The mullion body is configured to provide a support surface against which the door rests when the mullion body is in the second position and the door is closed.

In some embodiments, the door is a display case door for a temperature-controlled display case, the display case door comprising an insulated glass panel. In some embodiments, the pivoting mullion further includes a hinge pivotally attached to the mullion body and a mounting bracket having a first end attached to the hinge and a second end attached to an inward-facing surface of a frame segment of the door. In some embodiments, the mullion body is pivotally attached to the door via the hinge and the mounting bracket. The mounting bracket may be configured to attach to a display case door having an insulated glass panel.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
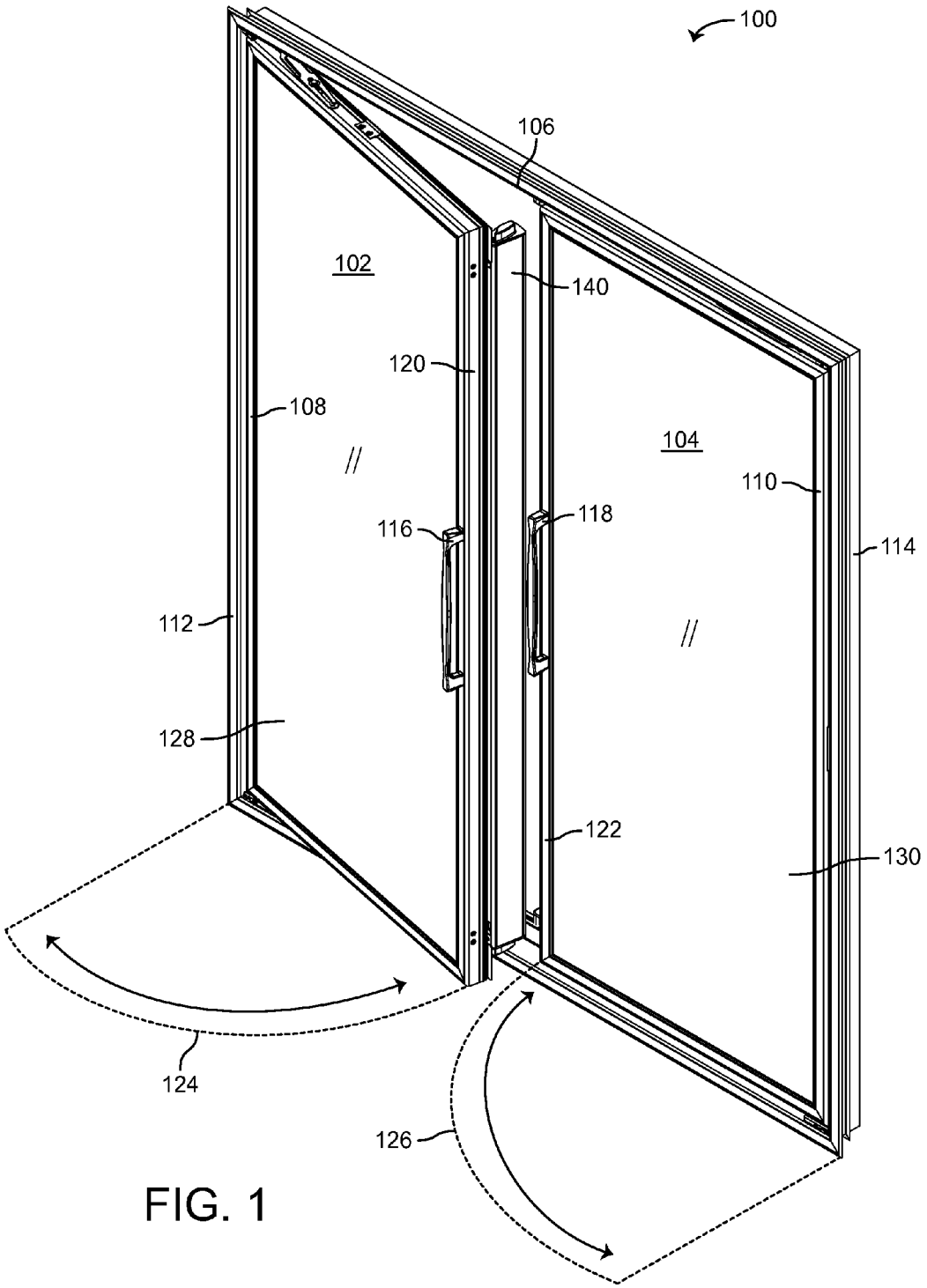
FIG. 1 is a front perspective view of display case door assembly with a pivoting mullion attached to one of the display case doors, according to an exemplary embodiment.

Referring generally to the FIGURES, a pivoting mullion for a temperature-controlled storage device and components thereof are shown, according to various exemplary embodiments. The pivoting mullion described herein may be used with a temperature-controlled storage device having French-style display case doors (e.g., doors that are hingedly connected to opposite sides of a door opening) to create a central support surface against which the doors can rest in a sealed fashion when the doors are in a closed position. The pivoting mullion of the present disclosure may be pivotally attached to a rear surface of one of the display case doors and may be configured to rotate between an open position and a closed position. In some embodiments, the pivoting mullion may be configured to rotate by approximately 90 degrees relative to the display case door to which the pivoting mullion is attached.

In some embodiments, rotation between the open position and the closed position is accomplished by a cam extending from the pivoting mullion. The cam may be configured to engage a cam guide fixedly attached to a door frame for the display case doors. When the door to which the pivoting mullion is attached is opened or closed, engagement between the cam and the cam guide may cause the pivoting mullion to rotate between the open position and the closed position. In some embodiments, the pivoting mullion described herein includes a magnetic element configured to hold the pivoting mullion in the open position when the display case door to which the pivoting mullion is attached is open or partially open.

Advantageously, the pivoting mullion of the present disclosure may be configured to attach to an insulated display case door for a temperature-controlled display case. The display case door may have a transparent or semi-transparent surface (e.g., insulated glass, etc.) through which items within the temperature-controlled display case may be viewed when the display case door is closed. In some embodiments, the pivoting mullion includes a lighting element. The lighting element may be configured to illuminate when the display case door is closed, thereby providing lighting for viewing items within the temperature-controlled storage device through the transparent or semi-transparent surface. The lighting element may be configured to turn off when the display case door is opened.

Before discussing further details of the pivoting mullion and/or the components thereof, it should be noted that references to "front," "back," "rear," "upward," "downward," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Figure 2:
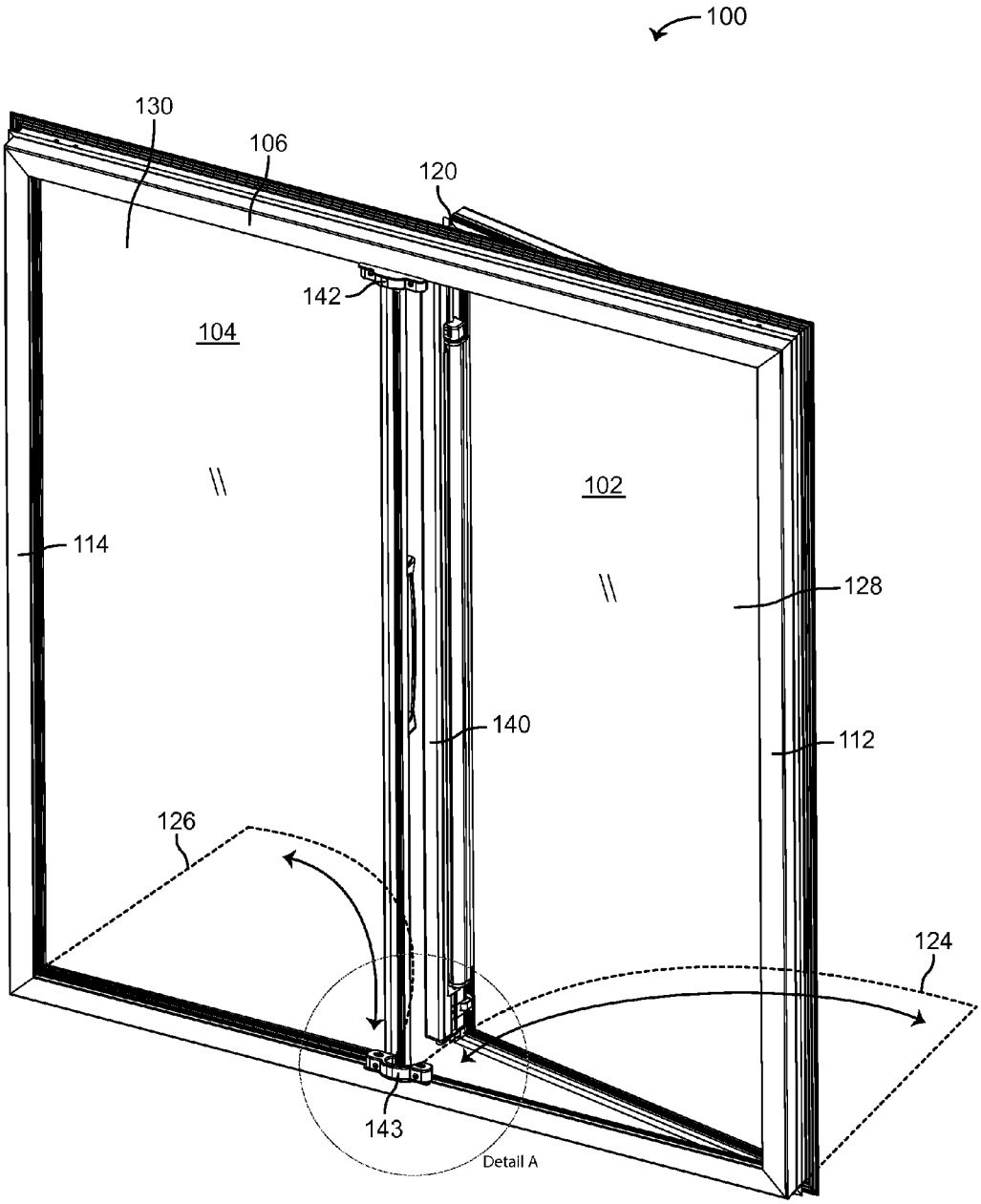
FIGS. 2-3 are rear perspective views of the display case door assembly of FIG. 1, according to an exemplary embodiment.
Figure 3:
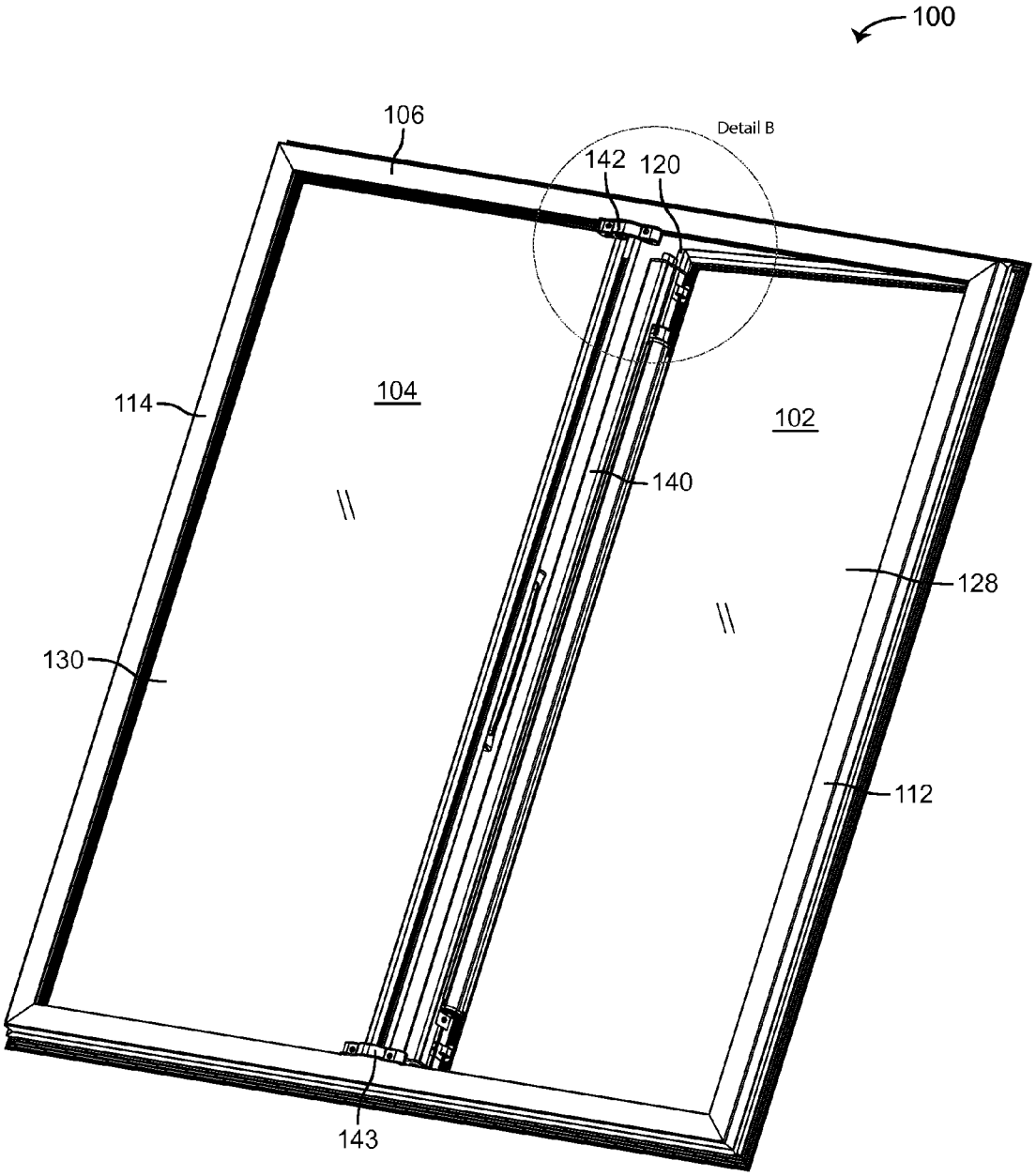
Figure 4:
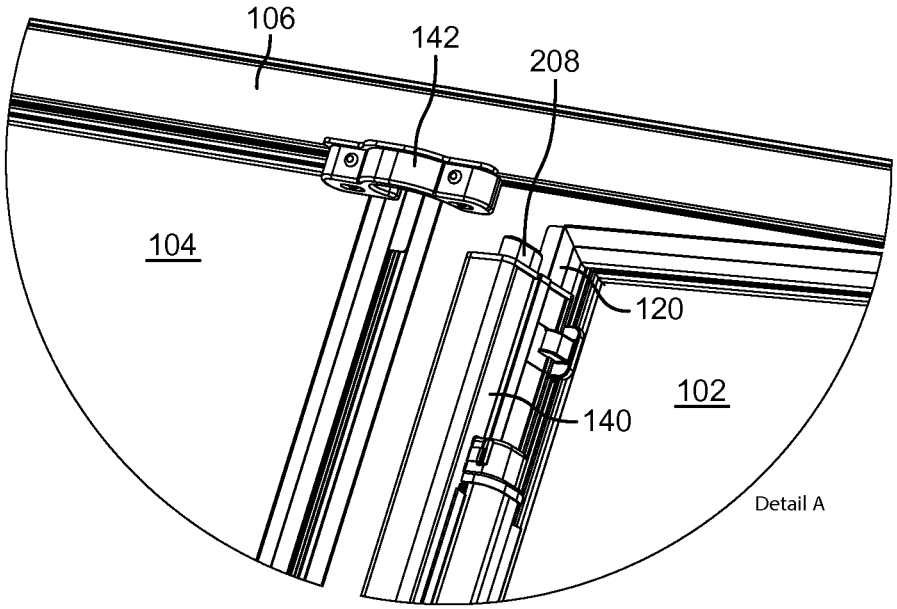
FIG. 4 illustrates section A of FIG. 2 in greater detail, according to an exemplary embodiment.
Figure 5:
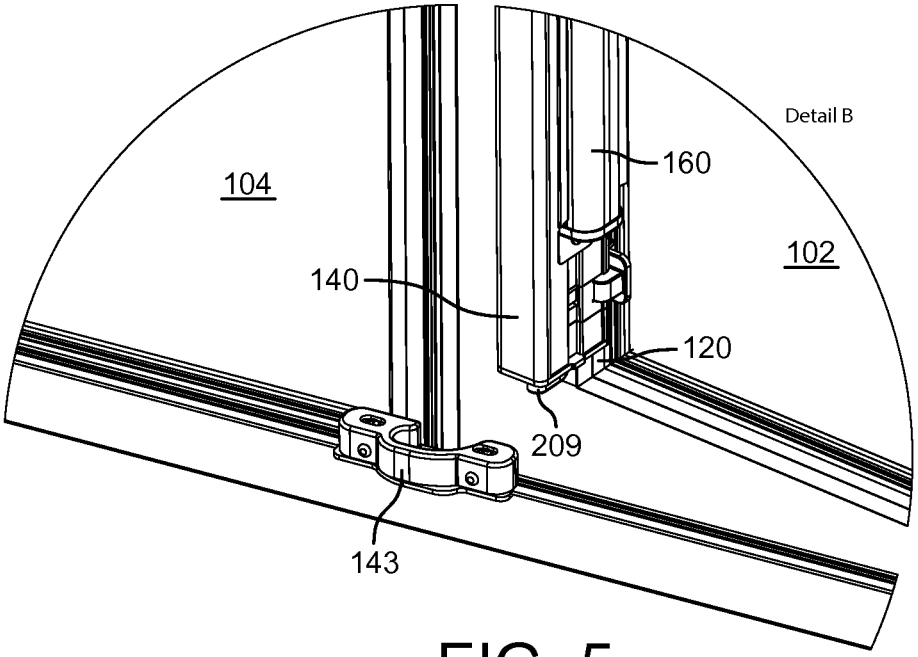
FIG. 5 illustrates section B of FIG. 3 in greater detail, according to an exemplary embodiment.

Referring now to FIGS. 1-5, a display case door assembly 100 is shown, according to an exemplary embodiment. FIG. 1 illustrates a front perspective view of display case door assembly 100 and FIGS. 2-3 illustrate a rear perspective view of display case door assembly 100. FIG. 4 is a more detailed view of section A shown in FIG. 2. FIG. 5 is a more detailed view of section B shown in FIG. 3. Display case door assembly 100 may be a used in conjunction with a temperature-controlled storage device (e.g., a refrigerator, a freezer, a warmer, etc.) in a supermarket or other similar facility for displaying items which must be maintained at a particular temperature or within a particular temperature range.

Door assembly 100 is shown to include a pair of display case doors 102 and 104 mounted within a door frame 106. Display case doors 102 and 104 may be French-style display case doors which are hingedly connected to opposite sides of door frame 106. For example, display case door 102 is shown to include an outside frame segment 108 and display case door 104 is shown to include an outside frame segment 110. Outside frame segments 108 and 110 may be hingedly connected to left side 112 of door frame 106 and right side 114 of door frame 106, respectively.

Display case doors 102 and 104 are shown to further include inside frame segments 120 and 122. Inside frame segments 120 and 122 may be opposite outside frame segments 112 and 114 (e.g., along opposite parallel edges of doors 102 and 104), and are shown to include handles 116 and 118 mounted along front surfaces thereof. Handles 116 and 118 may be used to open display case doors 102 and 104. For example, pulling handle 116 may cause display case door 102 to swing open along path 124 and pulling handle 118 may cause display case door 104 to swing open along path 126.

Display case doors 102 and 104 are shown to further include transparent surfaces 128 and 130. Transparent surfaces 128 and 130 may be made of any transparent or semi-transparent material (e.g., glass, polymers, etc.) through which items within the temperature-controlled storage device can be viewed. In some embodiments, transparent surfaces 128 and 130 may be insulated (e.g., using multiple layers or panes, using an insulating material, etc.) to reduce an amount of heat transfer through surfaces 128 and 130.

Still referring to FIGS. 1-5, display case door assembly 100 is shown to include a pivoting mullion 140. As shown, pivoting mullion 140 is rotatably attached to a rear surface of inside frame segment 120. Pivoting mullion 140 may be attached to one of display case doors 102 or 104 and may be configured to rotate between an open position and a closed position. Pivoting mullion 140 may be configured to rotate (e.g., by approximately 90 degrees) relative to display case door 102 as display case door 102 is opened or closed. When pivoting mullion 140 is in the closed position, pivoting mullion 140 may create a central support surface against which display case doors 102 and 104 can rest in a sealed fashion. For example, pivoting mullion 140 may horizontally overlap with both inside frame segment 120 and inside frame segment 122 when pivoting mullion 140 is in the closed position. Conversely, when pivoting mullion 140 is in the open position, pivoting mullion 140 may not horizontally overlap with inside frame segment 122, thereby allowing display case doors 102 and 104 to be opened and closed independently.

Display case door assembly 100 is shown to further include cam guides 142 and 143 attached to door frame 106. Cam guide 142 may be attached to an upper horizontal segment of door frame 106 and cam 143 may be attached to a lower horizontal segment of door frame 106. In various embodiments, one or more of cam guides 142-143 may be present (e.g., only cam guide 142, only cam guide 143, or both cam guides 142-143). Cam guides 142-143 may be configured to engage one or more cams extending from pivoting mullion 140 as door 102 is opened or closed, thereby causing rotation of pivoting mullion 140 between the open position and the closed position. As shown in FIGS. 4-5, cam guide 142 may be configured to engage a first cam 208 extending upward from a top surface of pivoting mullion 140 and cam guide 143 may be configured to engage a second cam 209 extending downward from a bottom surface of pivoting mullion 140. In other embodiments, one or more of cam guides 142-143 may be replaced with stationary block extending inward from door frame 106. Pivoting mullion 140 may include one or more slots or grooves configured to receive the stationary block and to cause rotation of pivoting mullion 140 when display case door 102 is closed.

In some embodiments, pivoting mullion 140 includes a magnetic element configured to hold pivoting mullion 140 in the open position when display case door 102 is open or partially open. In some embodiments, pivoting mullion 140 includes a lighting element 160 configured to illuminate when display case doors 102 and 104 are closed, thereby providing lighting for the items displayed within the temperature-controlled storage device. In some embodiments, lighting element 160 is configured to turn on when display case doors 102-104 are closed and to turn off when display case doors 102-104 are open.

Figure 6:
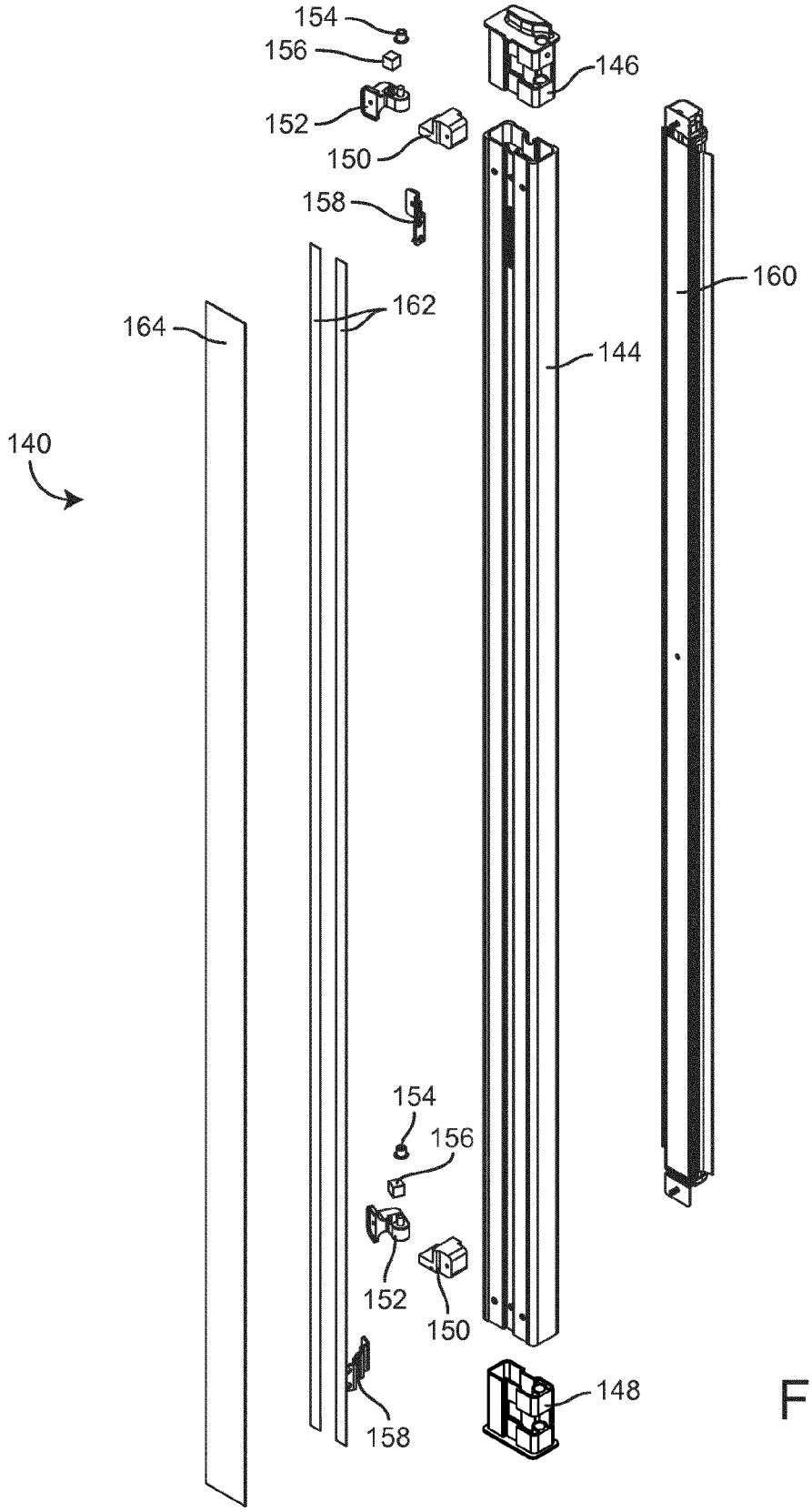
FIG. 6 is an exploded view of the pivoting mullion of FIG. 2, illustrating various components of the pivoting mullion including a mullion body, a top cover, a bottom cover, inserts, hinges, bushings, magnets, mounting brackets, and a lighting element, according to an exemplary embodiment.

Referring now to FIG. 6, an exploded view of pivoting mullion 140 is shown, according to an exemplary embodiment. Pivoting mullion 140 is shown to include a mullion body 144, a top cover 146, a bottom cover 148, inserts 150, hinges 152, bushings 154, magnets 156, mounting brackets 158, lighting element 160, strips 162, and sheet 164. In some embodiments, mullion body 144 includes an extruded channel filled with an insulating material. Top cover 146 and bottom cover 148 may be inserted into top and bottom openings of mullion body 144 and secured using screws or other fasteners. Inserts 150 may be inserted into side openings of mullion body 144 and secured in fixed relation to mullion body 144. Inserts 150 may be made at least partially of a magnetic material and/or configured to house a magnet or magnetic material.

Hinges 152 may be rotatably coupled to mullion body 144 (e.g., directly or indirectly via top cover 146, bottom cover 148, and/or bushings 154) and may be fixedly attached to display case door 102 using mounting brackets 158. Hinges 152 may be configured to house magnets 156. Magnets 156 may hold pivoting mullion 140 in an open position (e.g., via a magnetic force between magnets 156 and inserts 150), thereby preventing inadvertent rotation of mullion body 144 about hinges 152. Strips 162 and sheet 164 may be attached to a side surface of mullion body 144 to provide a sealing surface against which display case doors 102 and 104 can rest in a closed position. Components 144-164 are described in greater detail with reference to FIGS. 7-28.

Figure 7:
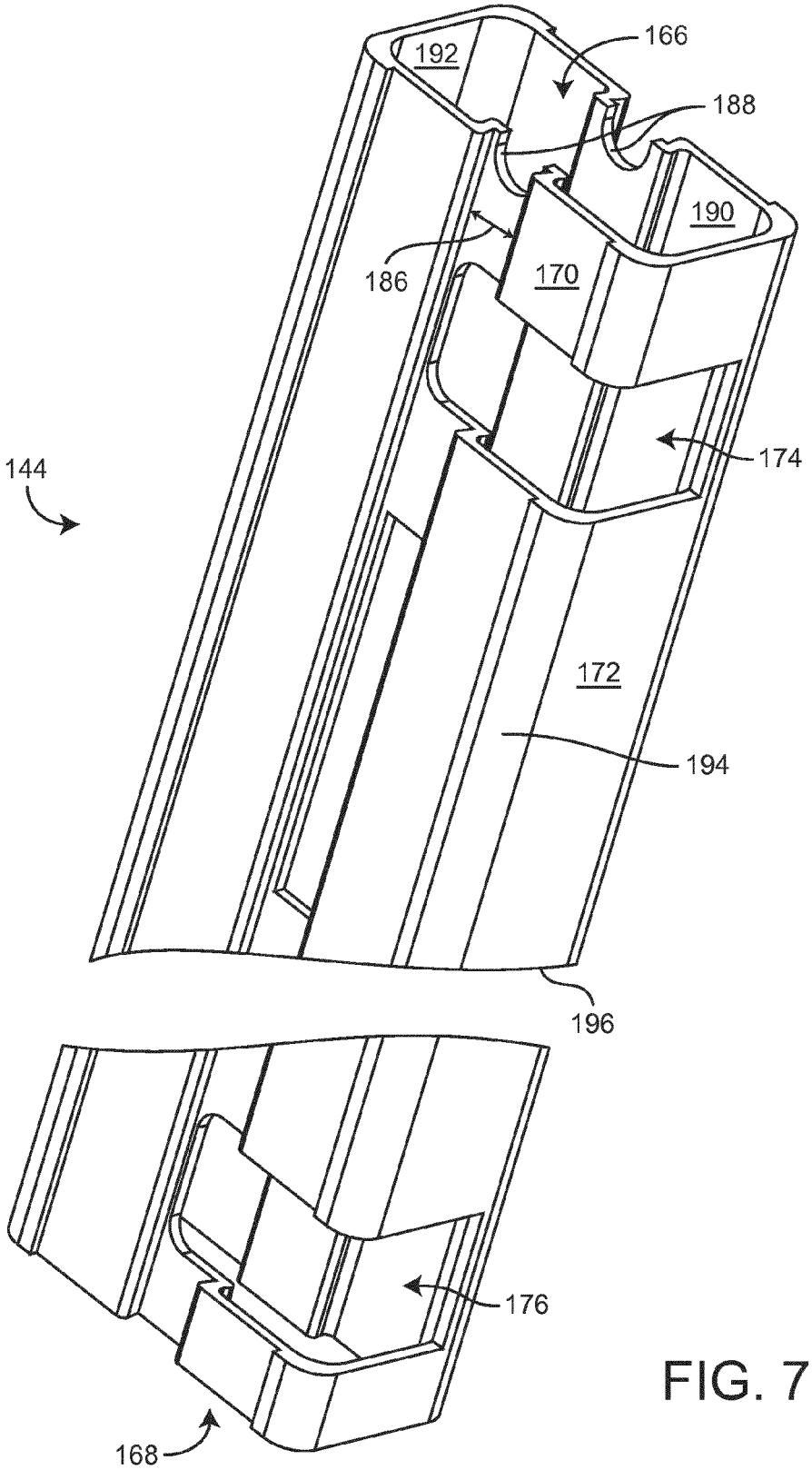
FIGS. 7-8 are drawings illustrating the mullion body of FIG. 6 in greater detail, according to an exemplary embodiment.
Figure 8:
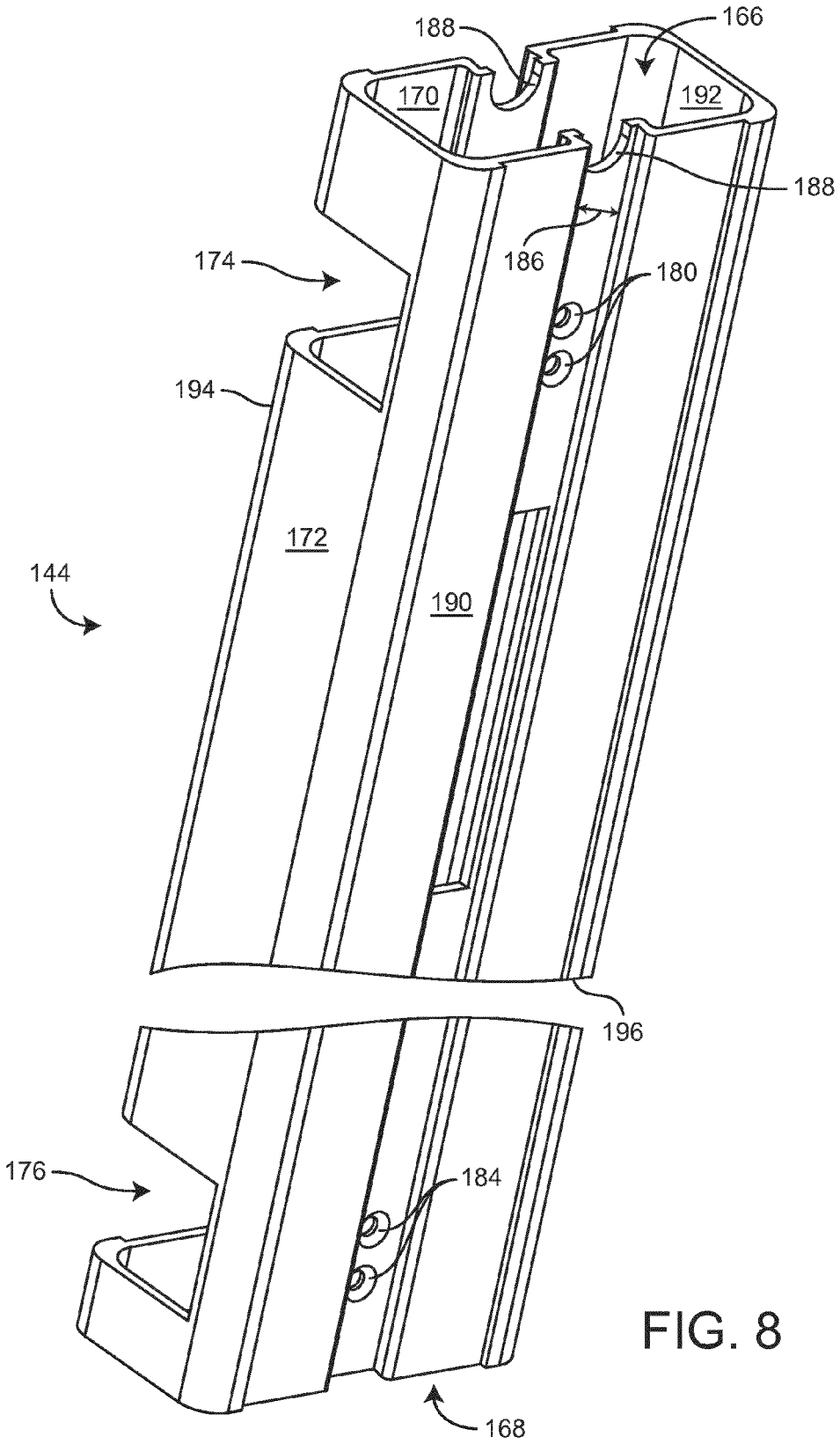

Referring now to FIGS. 7 and 8, mullion body 144 is shown in greater detail, according to an exemplary embodiment. FIG. 7 illustrates a rear perspective view of mullion body 144 and FIG. 8 illustrates a front perspective view of mullion body 144. Mullion body 144 is shown as a substantially rectangular channel having a rear face 170, a front face 190, and side faces 172 and 192. Front face 190 and rear face 170 may be substantially parallel to each other and separated by side faces 172 and 192. Side faces 172 and 192 may be substantially parallel to each other and substantially perpendicular to both front face 190 and rear face 170. In some embodiments, faces 170, 172, 190, and 192 form a closed channel.

Mullion body 144 may be formed using an extrusion process and may be an extruded channel. Mullion body 144 may have any length, as indicated by break lines 196. In some embodiments, mullion body 144 is a hollow channel. In other embodiments, mullion body 144 is filled with a polymer foam, an insulating foam, or another foamed or insulating material. Advantageously, filling mullion body 144 with an insulating foam may provide improved insulation for the temperature-controlled storage device.

Mullion body 144 is shown to further include a top opening 166, a bottom opening 168, a first side opening 174, and a second side opening 176. Top opening 166 and bottom opening 168 may be open faces of mullion body 144 along top and bottom ends thereof. Top opening 166 and bottom opening 168 may be configured to receive top cover 146 and bottom cover 148, respectively. First side opening 174 and second side opening 176 may be configured to receive inserts 150 and/or hinges 152 for rotatably coupling mullion body 144 with display case door 102. Although only two side openings 174 and 176 are shown, any number of side openings may be used. For example, for embodiments in which mullion body 144 is hingedly connected with display case door 102 using three or more hinges 152, three or more side openings may be used to accommodate the increased number of hinged connections.

In some embodiments, side openings 174 and 176 are "L-shaped" openings bending around an edge 194 of mullion body 144 from rear face 170 to side face 172. Advantageously, the L-shape of openings 174 and 176 may facilitate a 90 degree rotation of mullion body 144 about an axis of rotation within mullion body 144. For example, when mullion body 144 is in a closed position, hinges 152 may extend through the portion of openings 174 and 176 formed in side face 172. When mullion body 144 is rotated into an open position, hinges 152 may extend through the portion of openings 174 and 176 formed in rear face 170. By using L-shaped openings 174 and 176, the axis of rotation for pivoting mullion 140 can be located within mullion body 144, thereby conserving space and resulting in a more compact arrangement.

In some embodiments, mullion body 144 includes one or more notches 188 and one or more grooves 186. Notches 188 are shown as semicircular holes extending through rear face 170 and front face 190. Notches 188 may be located at the intersections of rear and front faces 170 and 190 with top opening 166 and may be used to distinguish top opening 166 from bottom opening 168 (e.g., for orienting mullion body 144 relative to display case door 102, for inserting top cover 146 and bottom cover 148, etc.). Grooves 186 may be depressions or indentations extending longitudinally along rear face 170 and front face 190 between top opening 166 and bottom opening 168. Grooves 186 may be used to align top cover 146, bottom cover 148, and/or inserts 150 with mullion body 144.

Referring specifically to FIG. 8, in some embodiments, mullion body 144 includes one or more holes 180 and 184. Holes 180 are shown extending through front face 190 proximate to top opening 166 and holes 184 are shown extending through front face 190 proximate to bottom opening 168. Holes 180-184 may be used to align and/or secure top cover 146 and bottom cover 148 (respectively) to mullion body 144 and to secure inserts 150 in a fixed position relative to covers 146-148 and/or mullion body 144 (e.g., via a screw or other fastener extending through holes 180 and 184).

Figure 9:
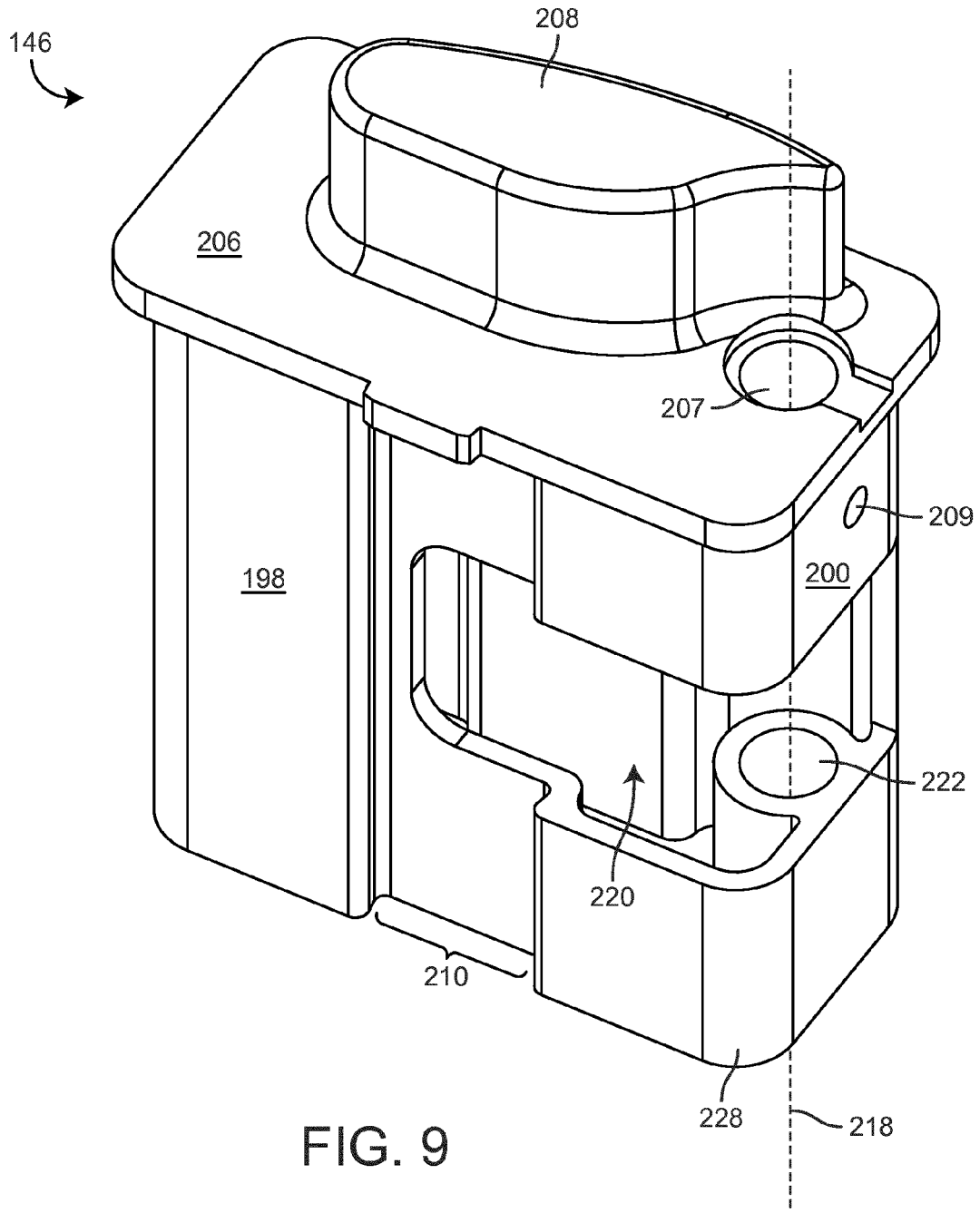
FIGS. 9-11 are drawings illustrating the top cover of FIG. 6 in greater detail, according to an exemplary embodiment.
Figure 10:
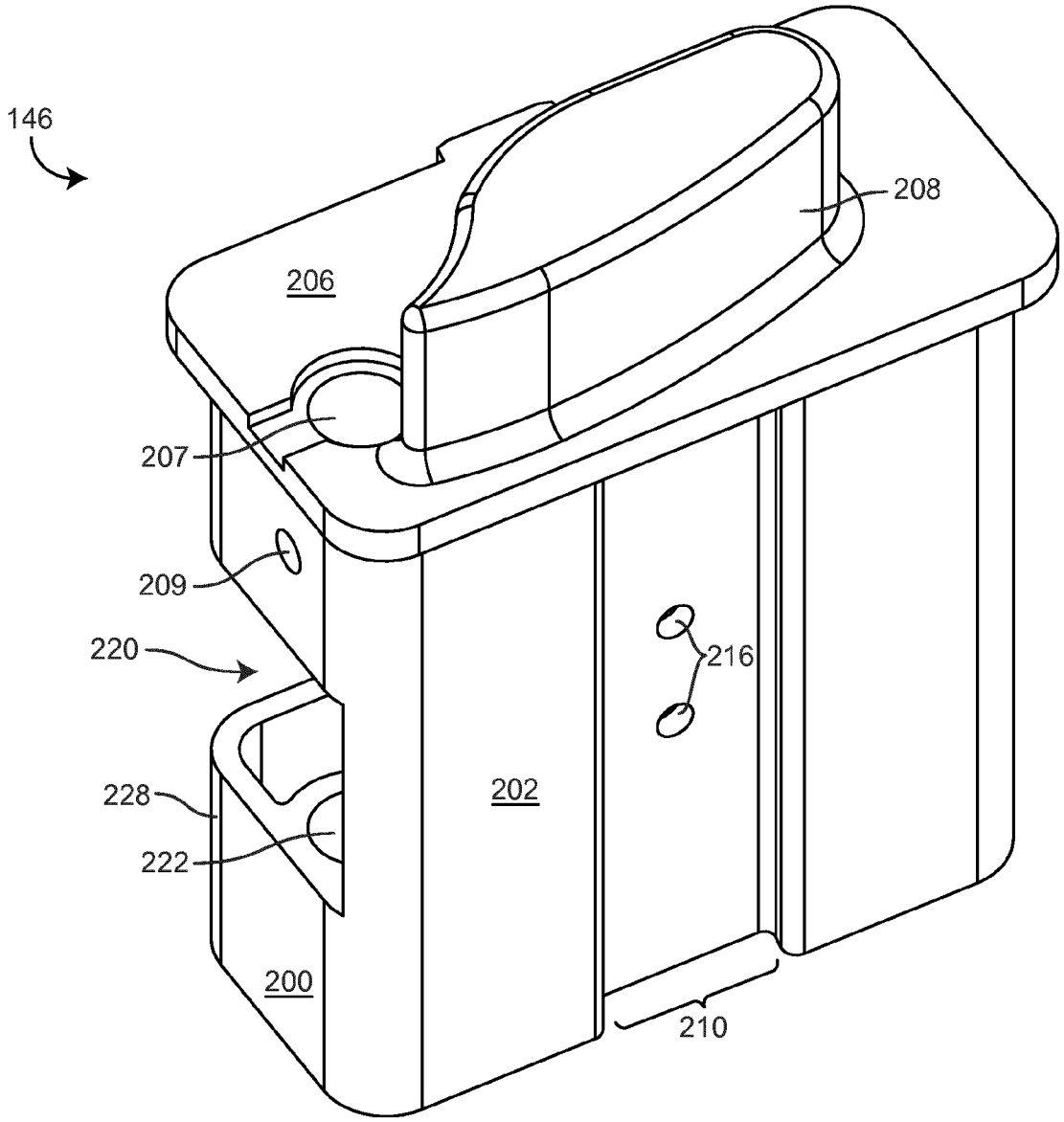
Figure 11:
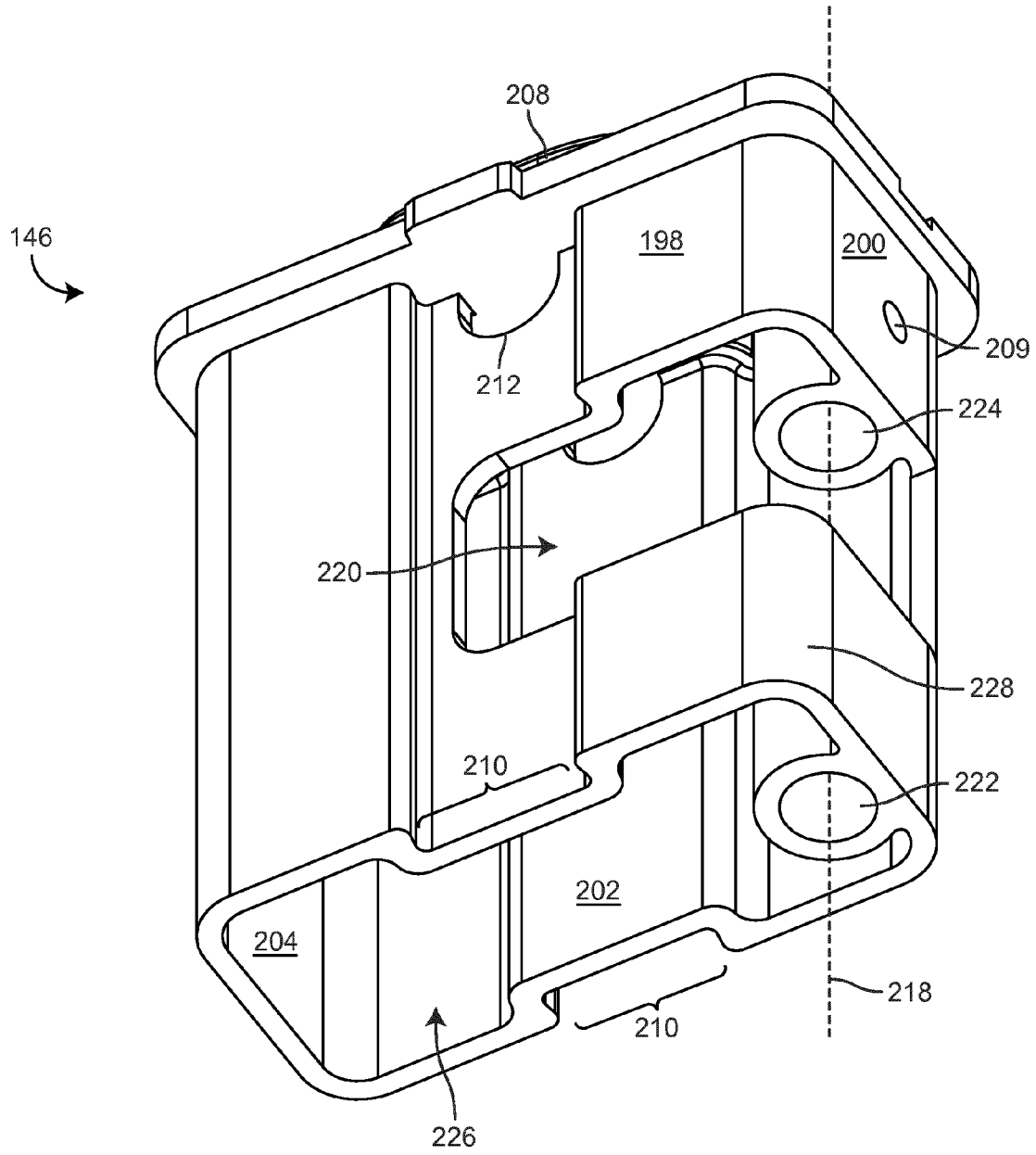

Referring now to FIGS. 9-11, top cover 146 is shown in greater detail, according to an exemplary embodiment. Top cover 146 is shown having a substantially rectangular cross section consisting of a rear face 198, a front face 202, and side faces 200 and 204. Top cover 146 is shown to include a closed top surface 206 and a bottom opening 226. Top cover 146 may be configured to fit within top opening 166 in mullion body 144 and may be inserted into top opening 166 during assembly.

In some embodiments, top cover 146 includes one or more notches 212 and one or more grooves 210. Notches 212 are shown as semicircular holes extending through rear face 198 and front face 202. Notches 212 may be located at an intersection of rear and front faces 198,202 with top face 206. Grooves 210 may be depressions or indentations extending longitudinally along front face 202 and rear face 198 between top surface 206 and bottom opening 226. When top cover 146 is inserted into top opening 166, notches 212 may align with notches 188 and grooves 210 may align with grooves 186.

Top cover 146 is shown to further include a side opening 220. In some embodiments, side opening 220 is a "L-shaped" opening bending around an edge 228 of top cover 146 from rear face 198 to side face 200. Side opening 220 may be configured to receive insert 150 and/or hinge 152 for rotatably coupling top cover with display case door 102. When top cover 146 is inserted into top opening 166, opening 220 may align with side opening 174 in mullion body 144. This alignment is described in greater detail with reference to FIG. 14.

Top cover 146 is shown to include a lower hinge connector 222 and an upper hinge connector 224. Hinge connectors 222 and 224 are shown as substantially cylindrical channels extending vertically within top cover 146 (e.g., between top surface 206 and bottom opening 226). In some embodiments, hinge connectors 222 and 224 are coaxial having a shared central axis 218. Hinge connectors 222 and 224 may be configured to receive a pin extending from hinge 152 when hinge 152 is inserted into opening 220, thereby rotatably coupling top cover 146 with hinge 152. The pin may be inserted along axis 218 (e.g., through hole 207) and secured with a fastener inserted into hole 209. Top cover 146 may be configured to rotate about axis 218.

Top cover 146 is shown to further include a cam 208 extending upward from top surface 206. Cam 208 may be configured to engage a cam slot of cam guide 142 when display case door 102 is moved into a closed position. The engagement between cam 208 and cam guide 142 may cause top cover 146 to rotate about axis 218 between the open position and the closed position.

Referring specifically to FIG. 10, in some embodiments, top cover 146 includes one or coupling holes 216. Holes 216 are shown extending through front surface 202. When top cover 146 is inserted into top opening 166, holes 216 may align with one or more of holes 180-184 in mullion body 144. For example, when top cover 146 is inserted into top opening 166, one of holes 216 may align with hole 180 in mullion body 144. Holes 216 may be configured to receive fasteners for securing top cover 146 in a fixed position relative to mullion body 144. A screw or other fastener extending through holes 216 and 180 may be used to secure mullion body 144 to top cover 146.

Figure 12:
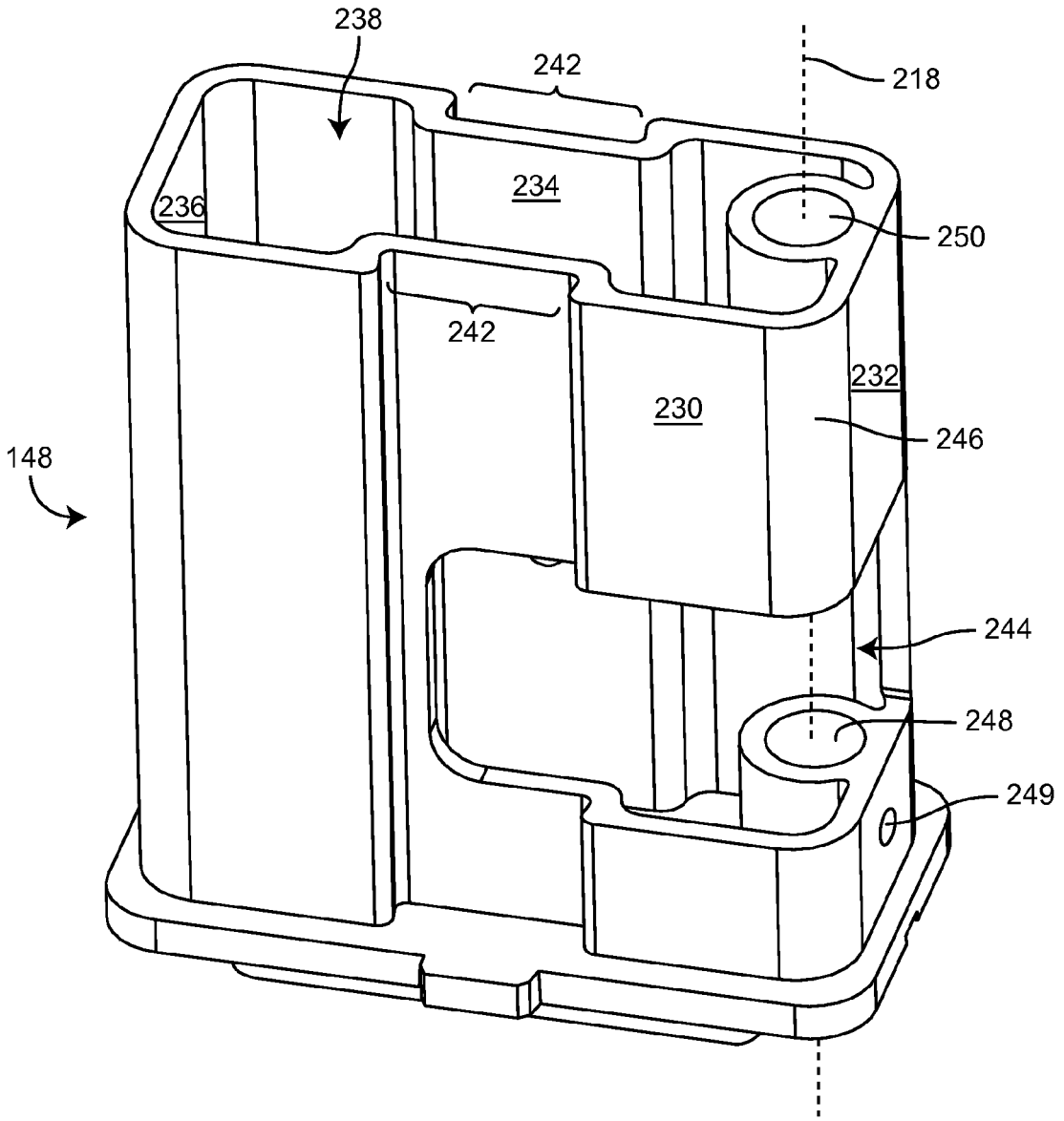
FIGS. 12-13 are drawings illustrating the bottom cover of FIG. 6 in greater detail, according to an exemplary embodiment.
Figure 13:
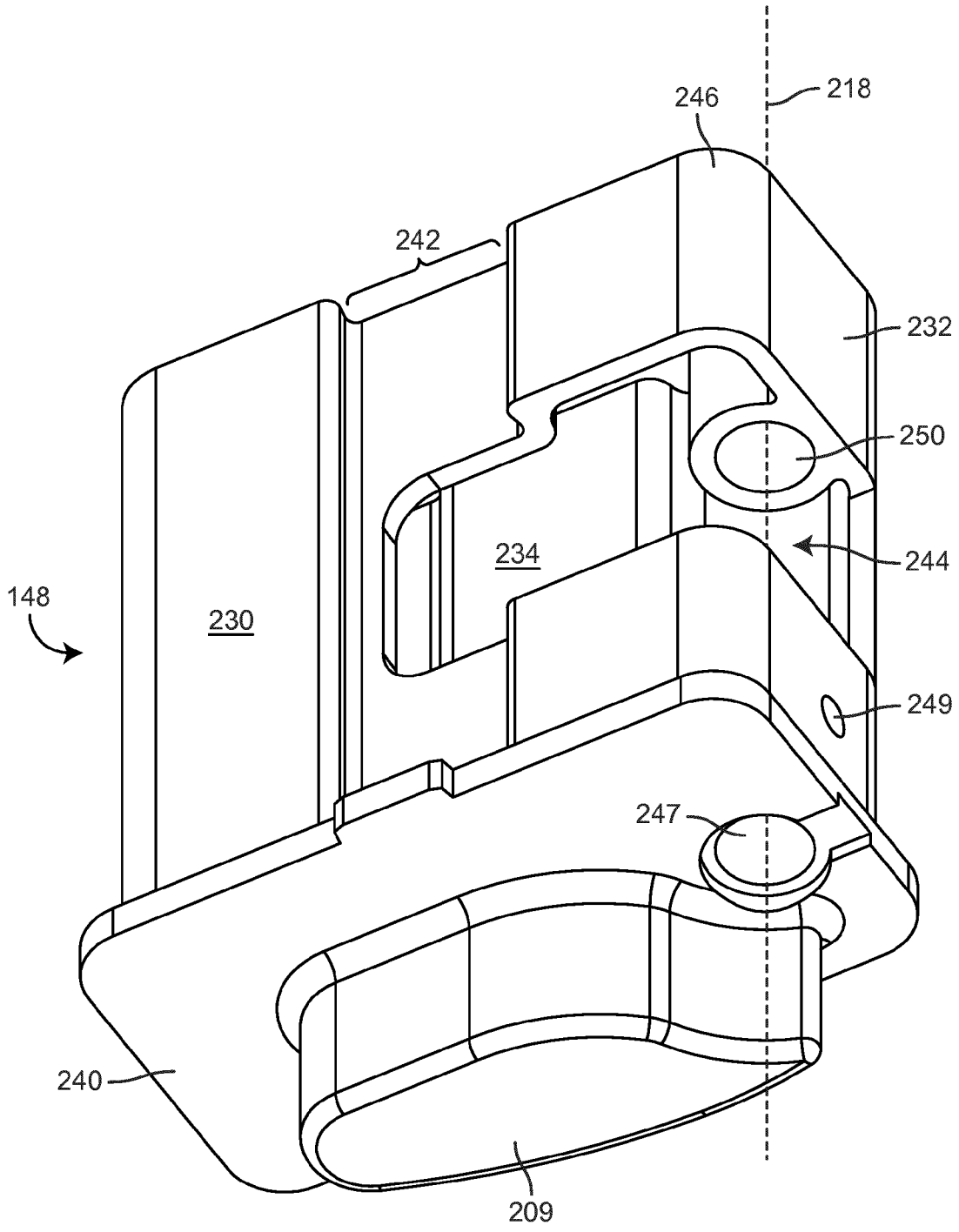

Referring now to FIGS. 12-13, bottom cover 148 is shown in greater detail, according to an exemplary embodiment. Bottom cover 148 is shown having a substantially rectangular cross section consisting of a rear face 230, a front face 234, and side faces 232 and 236. Bottom cover 148 is shown to include a top opening 238 and a closed bottom surface 240. Bottom cover 148 may be configured to fit within bottom opening 168 in mullion body 144 and may be inserted into bottom opening 168 during assembly.

In some embodiments, bottom cover 148 includes one or more grooves 242. Grooves 242 may be depressions or indentations extending longitudinally along front face 234 and rear face 230 between top opening 238 and bottom surface 240. When bottom cover 148 is inserted into bottom opening 168, grooves 242 may align with grooves 186 in mullion body 144.

Bottom cover 148 is shown to further include a side opening 244. In some embodiments, side opening 244 is a "L-shaped" opening bending around an edge 246 of bottom cover 148 from rear face 230 to side face 232. Side opening 244 may be configured to receive insert 150 and/or hinge 152 for rotatably coupling bottom cover with display case door 102. When bottom cover 148 is inserted into bottom opening 168, opening 244 may align with side opening 176 in mullion body 144.

Bottom cover 148 is shown to include a lower hinge connector 248 and an upper hinge connector 250. Hinge connectors 248 and 250 are shown as substantially cylindrical channels extending vertically within bottom cover 148 (e.g., between top opening 238 and bottom surface 240). In some embodiments, hinge connectors 248 and 250 are coaxial having a central axis 218. Hinge connectors 248 and 250 of bottom cover 148 may have the same central axis 218 as hinge connectors 222 and 224 of top cover 146. Hinge connectors 248 and 250 may be configured to receive a pin extending from hinge 152 when hinge 152 is inserted into opening 244, thereby rotatably coupling bottom cover 148 with hinge 152. The pin may be inserted along axis 218 (e.g., through hole 247) and may be secured by a fastener inserted into hole 249. Bottom cover 148 may be configured to rotate about axis 218 along with mullion body 144.

Bottom cover 148 is shown to further include a cam 209 extending downward from bottom surface 240. Cam 209 may be configured to engage a cam slot of cam guide 143 when display case door 102 is moved into a closed position. The engagement between cam 209 and cam guide 143 may cause bottom cover 148 to rotate about axis 218 between the open position and the closed position.

Figure 14:
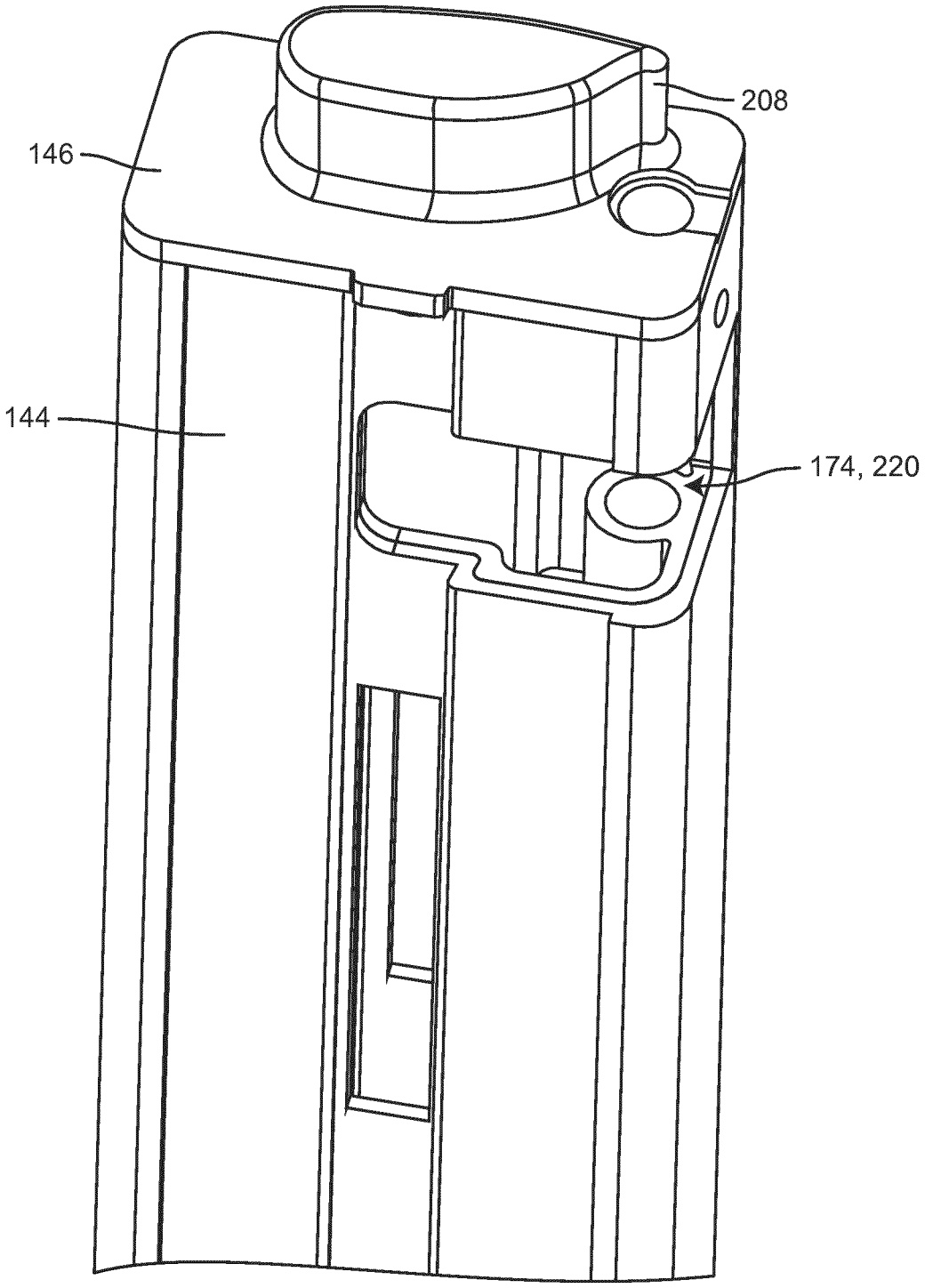
FIG. 14 is a drawing of the top cover of FIGS. 9-11 inserted into a top opening of the mullion body, according to an exemplary embodiment.

Referring now to FIG. 14, a drawing of top cover 146 inserted into top opening 166 is shown, according to an exemplary embodiment. When top cover 146 is inserted into top opening 166, side opening 174 in mullion body 144 may align with opening 220 in top cover 146. Advantageously, this alignment may allow insert 150 and hinge 152 to be inserted through both openings 174 and 220 simultaneously. Bottom cover 148 may align with mullion body 144 in a similar manner. For example, when bottom cover 148 is inserted into bottom opening 168, side opening 176 in mullion body 144 may align with opening 244 in bottom cover 148. This alignment may allow insert 150 and hinge 152 to be inserted through both openings 176 and 244 simultaneously.

Figure 15:
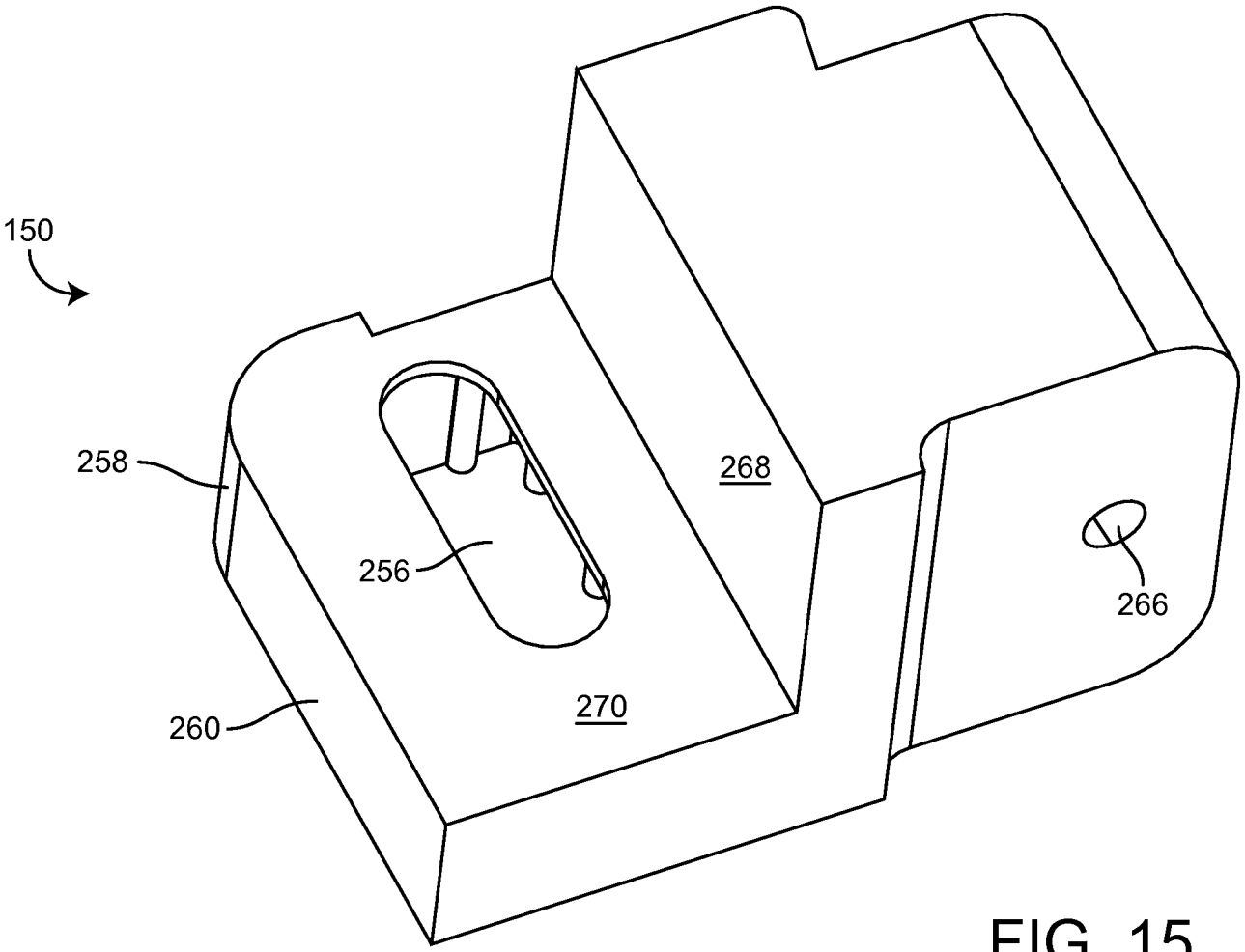
FIGS. 15-16 are drawings illustrating the insert of FIG. 6 in greater detail, according to an exemplary embodiment.
Figure 16:
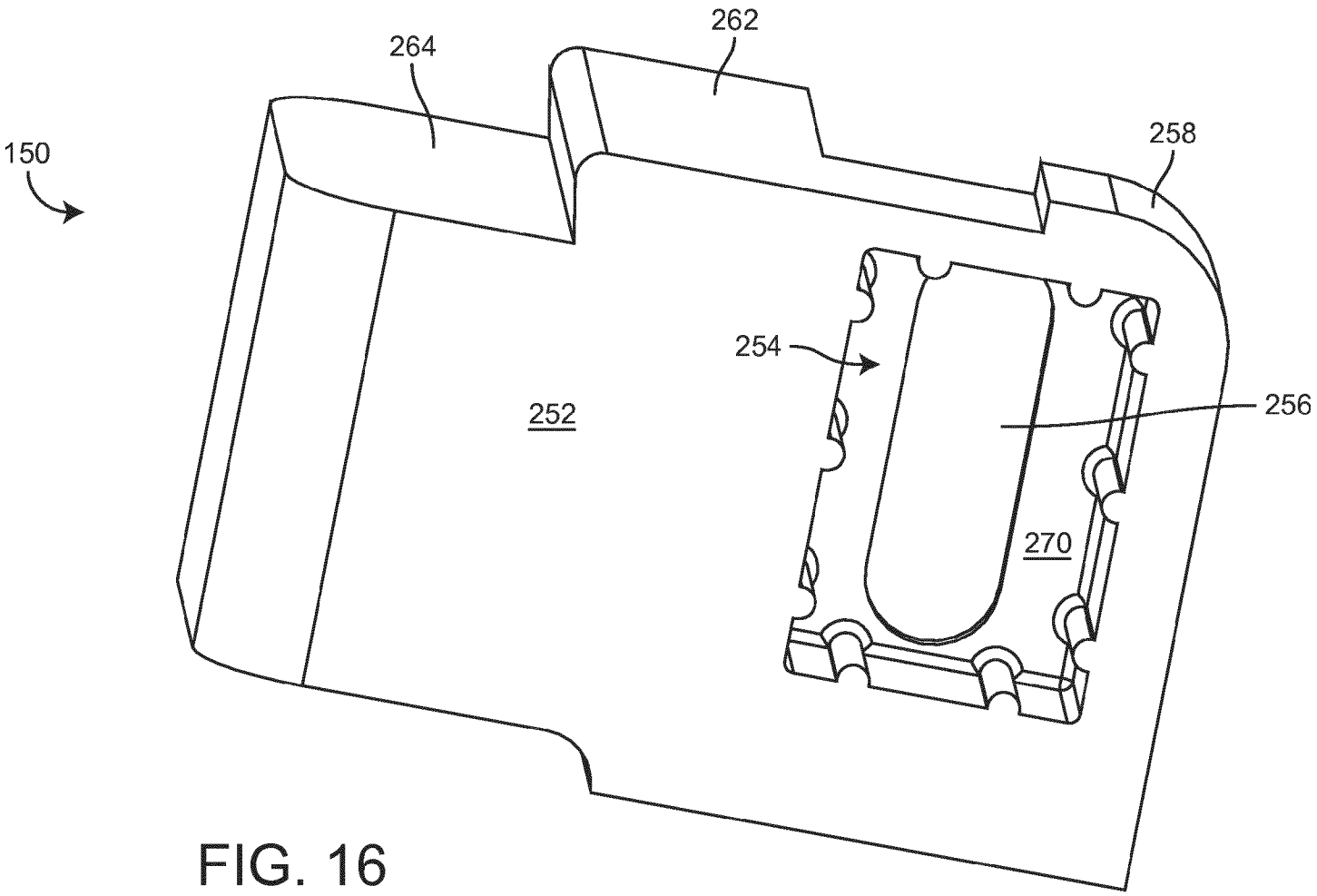

Referring now to FIGS. 15 and 16, insert 150 is shown in greater detail, according to an exemplary embodiment. FIG. 15 illustrates an upper perspective view of insert 150 and FIG. 16 illustrates a lower perspective view of insert 150. Insert 150 may be inserted into mullion body 144 through side opening 174 and/or side opening 176. For embodiments in which mullion body 144 has multiple side openings, multiple inserts 150 may be used. For example, a first of inserts 150 may be inserted through side opening 174 and a second of inserts 150 may be inserted through side opening 176.

Insert 150 is shown to include a rear surface 262, a side surface 260, and a curved corner 258 extending therebetween. When insert 150 is inserted into side opening 174 and/or side opening 176 of mullion body 144, rear surface 262 may align with rear face 170, side surface 260 may align with side face 172, and curved corner 258 may align with edge 194. In some embodiments, insert 150 includes an offset surface 264. When insert 150 is inserted into side opening 174 and/or side opening 176 of mullion body 144, offset surface 264 may align with one of grooves 186. This alignment may ensure a proper positioning of insert 150 relative to mullion body 144.

Referring specifically to FIG. 15, in some embodiments, insert 150 includes a hole 266. Hole 266 may be configured to align with hole 180 of mullion body 144 (e.g., if insert 150 is inserted into side opening 174) or hole 184 of mullion body 144 (e.g., if insert 150 is inserted into side opening 176). A screw or other fastener may be inserted through hole 266 and holes 180,184 for securing insert 150 in a fixed position relative to mullion body 144.

Insert 150 is shown to include a lower surface 252 having a recess 254 extending upward therefrom (e.g., into insert 150). In some embodiments, recess 254 is configured to house a magnet (e.g., one of magnets 156) or a magnetic material (e.g., a ferromagnetic material, a paramagnetic material, etc.). The magnet or magnetic material housed in recess 254 may magnetically engage a corresponding magnet or magnetic material housed within hinge 152. Advantageously, the magnetic force between insert 150 and hinge 152 may hold insert 150 in a stable position relative to hinge 152, thereby preventing inadvertent rotation of pivoting mullion 140 between the open position and the closed position. In some embodiments, a magnet or magnetic material may be embedded into surface 268 in addition to or in place of recess 254. In some embodiments, insert 150 may itself be made of a magnet or a magnetic material.

Insert 150 is shown to include a slot 256 extending through an upper surface 270 of recess 254. In some embodiments, slot 256 allows a pin extending from hinge 152 to extend through insert 150 and engage hinge connector 222. In some embodiments, slot 256 provides an increased magnetic permeability between recess 254 and hinge 152. The increased magnetic permeability may increase the magnetic force between insert 150 and hinge 152.

Figure 17:
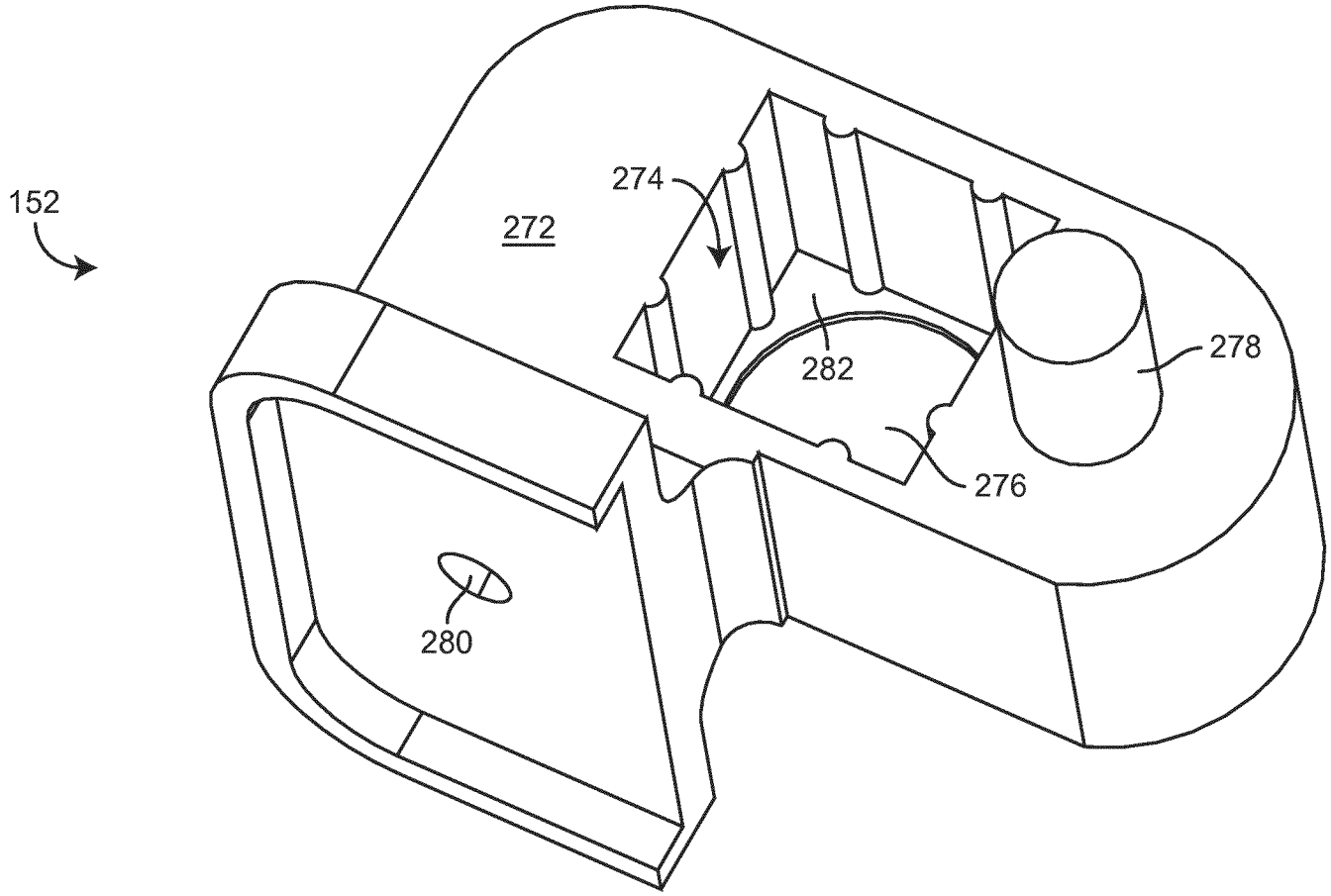
FIG. 17 is a drawing illustrating the hinge of FIG. 6 in greater detail, according to an exemplary embodiment.

Referring now to FIG. 17, hinge 152 is shown in greater detail, according to an exemplary embodiment. Hinge 152 is shown to include an upper surface 272 of a transverse portion having a pin 278 extending upward therefrom (e.g., away from hinge 152). The transverse portion of hinge 152 may extend through a horizontal-facing surface of mullion body 144 (e.g., a side surface, a rear surface, a front surface, etc.)

Pin 278 may be inserted into one of hinge connectors 222 or 224 of top cover 146 (e.g., if hinge 152 is inserted into side opening 174) or one of hinge connectors 248 or 250 of bottom cover 148 (e.g., if hinge 152 is inserted into side opening 176). Pin 278 may be aligned with axis 218 upon insertion and may facilitate rotation of pivoting mullion 140 about axis 218. In some embodiments, pin 278 is inserted directly into one of hinge connectors 222, 224, 248, or 250. In other embodiments, a bushing (e.g., bushing 154) or a bearing may be inserted between pin 278 and the hinge connector into which pin 278 is inserted.

In some embodiments, pin 278 extends from a lower surface of hinge 152 or from both the lower surface and upper surface 272 (e.g., a double-sided pin or axle). In other embodiments, a single sided pin 278 is sufficient to rotatably couple hinge 152 to mullion body 144. In some embodiments, pin 278 may be replaced with a recess configured to receive a pin extending from top cover 146, bottom cover 148, and/or mullion body 144. For example, pin 278 may be replaced with a hole or indentation configured to receive a pin inserted through holes 207 in top cover 146 or through hole 247 in bottom cover 148. Advantageously, such a configuration may allow hinge 152 to be inserted straight into one of side openings 172-174 and subsequently rotatably coupled with mullion body 144 via the pin inserted along axis 218.

Hinge 152 is shown to include an upper surface 272 having a recess 274 extending downward therefrom (e.g., into hinge 152). Recess 274 may be configured to house a magnet (e.g., one of magnets 156) or a magnetic material (e.g., a ferromagnetic material, a paramagnetic material, etc.). The magnet or magnetic material housed in recess 274 may magnetically engage insert 150 (e.g., via a magnetic attraction or repulsion force) to hold insert 150 in a stable position relative to hinge 152. Advantageously, the magnetic holding force between hinge 152 and insert 150 may preventing inadvertent rotation of insert 150 and pivoting mullion 140 when display case door 102 is in an open or partially open position.

Hinge 152 is shown to include a circular opening 276 extending through a lower surface 282 of recess 274. In some embodiments, opening 276 provides an increased magnetic permeability between recess 274 and insert 150 while preventing magnet 156 from being pulled through opening 276. The increased magnetic permeability may increase the magnetic holding force between insert 150 and hinge 152.

Hinge 152 is shown to further include a mounting hole 280. Mounting hole 280 may be configured to receive a screw or other fastener for fixedly attaching hinge 152 to display case door 102 (e.g., directly or indirectly via a mounting bracket or other intermediate element). Hinge 152 may be fixed relative to display case door 102 and may rotate along with display case door 102 when display case door is opened and closed.

Figure 18:
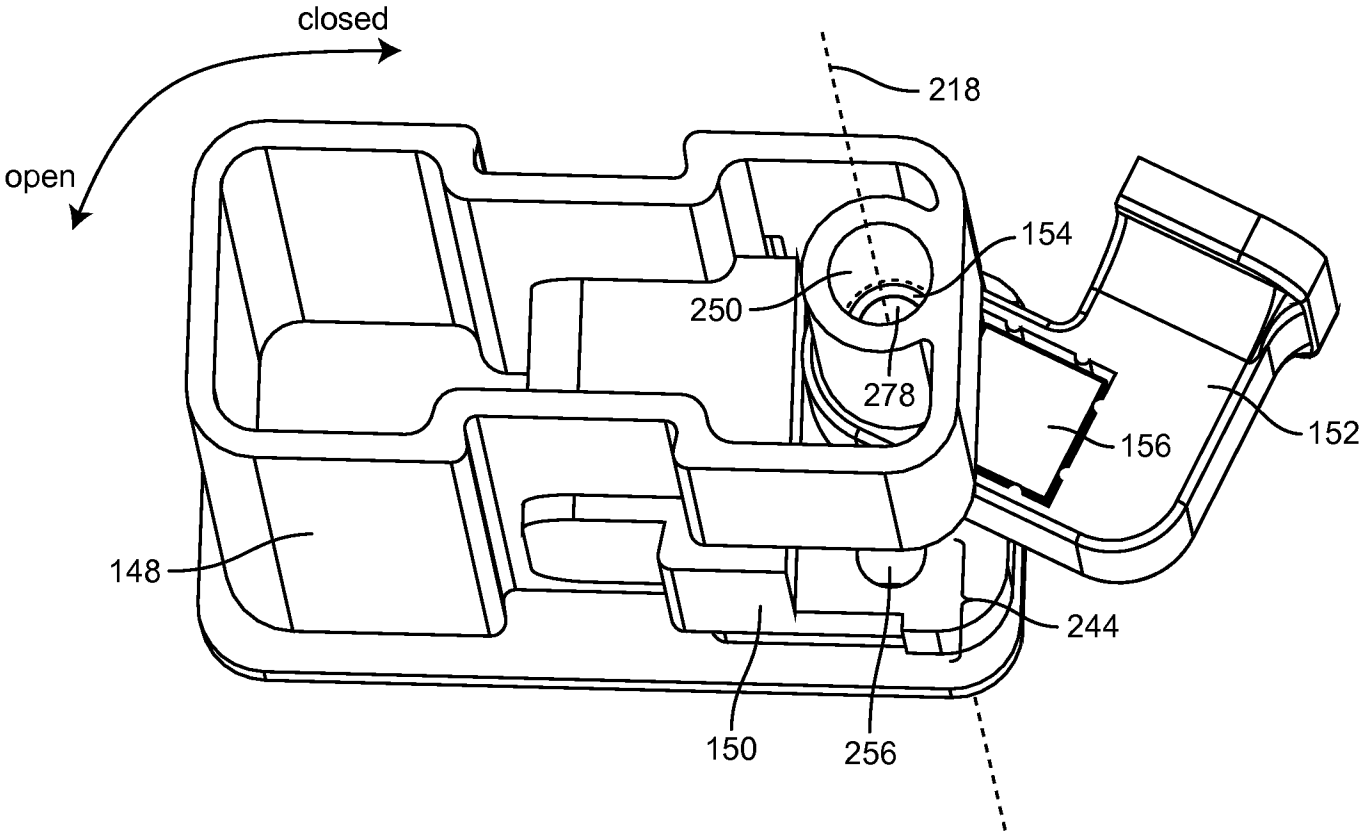
FIG. 18 is a drawing illustrating a rotatable connection between the hinge of FIG. 17 and the bottom cover of FIGS. 12-13, according to an exemplary embodiment.

Referring now to FIG. 18, a rotatable connection between hinge 152 and bottom cover 148 is shown, according to an exemplary embodiment. Bottom cover 148 is shown with insert 150 and hinge 152 inserted through opening 244. In an actual assembly of pivoting mullion 140, mullion body 144 would be fixed to bottom cover 148 prior to inserting hinge 152 and insert 150. However, in FIG. 18, mullion body 144 is omitted such that the rotatable connection can be seen more easily.

As shown in FIG. 18, pin 278 is inserted into hinge connector 250 such that pin 278 is aligned with axis 218. In some embodiments, bushing 154 may be provided between pin 278 and hinge connector 250 to facilitate rotation of bottom cover 148 relative to hinge 152 (e.g., by reducing rotational friction, by improving alignment, etc.). In some embodiments, pin 278 (or a second pin in addition to pin 278) may extend below hinge 152, through slot 256, and fit within hinge connector 248. In other embodiments, a single-sided pin such as pin 278 is sufficient to rotatably couple hinge 152 and bottom cover 148. When pin 278 is received in hinge connector 250, bottom cover 148 may be permitted to rotate about axis 218 relative to hinge 152.

Hinge 152 is shown to include a magnet 156 housed within recess 274. When bottom cover 148 is rotated into an open position (e.g., counter-clockwise in FIG. 18), magnet 156 may substantially align with slot 256 in insert 150. The substantial alignment of magnet 156 with slot 256 may provide a magnetic holding force for securing bottom cover 148 in the open position. When bottom cover 148 is rotated into a closed position (e.g., clockwise in FIG. 18), magnet 156 may be misaligned (e.g., not substantially aligned) with slot 256. The magnetic force between magnet 156 and insert 150 may bias bottom cover 148 (and pivoting mullion 140 as a whole) toward the open position.

The rotatable connection between hinge 152 and bottom cover 148 shown in FIG. 18 may be substantially similar or the same as the rotatable connection between hinge 152 and top cover 146 (not shown). However, in the rotatable connection between hinge 152 and top cover 146, hinge 152 may extend through opening 220 and pin 278 may be inserted into hinge connector 224. Pin 278 may be aligned with axis 218 such that top cover 146 and pivoting mullion 140 are permitted to rotate about axis 218 between the open position and the closed position.

Figure 19:
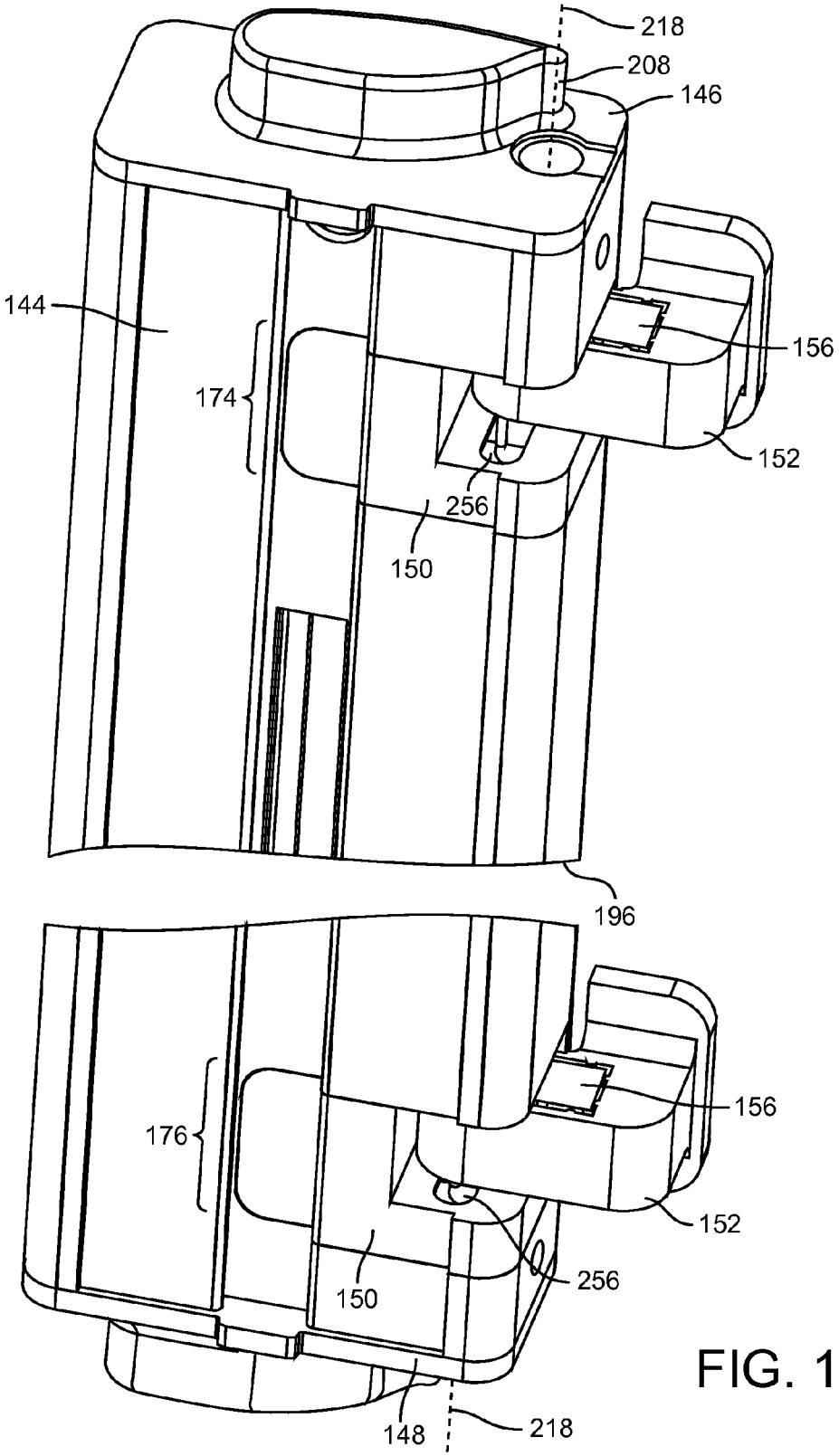
FIGS. 19-20 are drawings of the pivoting mullion of FIG. 6 in a partially assembled state, according to an exemplary embodiment.
Figure 20:
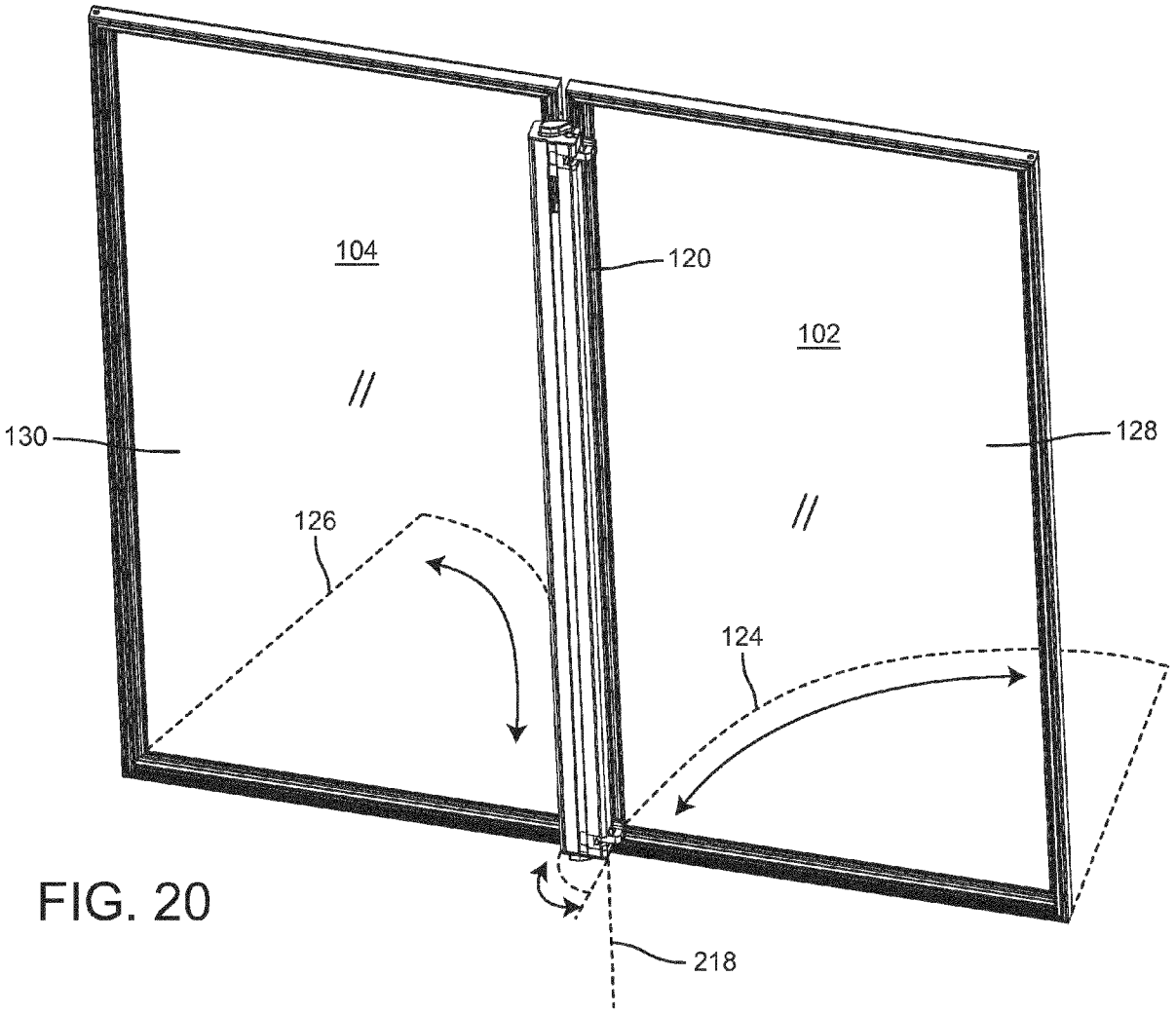

Referring now to FIGS. 19-20, pivoting mullion 140 is shown in a partially assembled state, according to an exemplary embodiment. FIG. 19 illustrates pivoting mullion 140 in isolation and FIG. 20 illustrates pivoting mullion 140 attached to display case door 102. Pivoting mullion 140 is shown with top cover 146 and bottom cover 148 inserted into top opening 166 and bottom opening 168 of mullion body 144 respectively. Pivoting mullion 140 is also shown with inserts 150 and hinges 152 inserted through both of side openings 174 and 176. FIGS. 19-20 illustrate pivoting mullion 140 in a closed position. In the closed position, magnets 156 may be misaligned with slots 256 and mullion body 144 may horizontally overlap both display case door 102 and display case door 104. Pivoting mullion 140 may be rotated into an open position by causing pivoting mullion 140 to rotate about axis 218.

Referring specifically to FIG. 20, pivoting mullion 140 is shown attached to display case door 102. Pivoting mullion 140 may be attached to display case door 102 via a fixed connection between hinges 152 and inside frame segment 120. In some embodiments, hinges 152 may be attached directly to inside frame segment 120 (e.g., to a rear surface of inside frame segment 120). In other embodiments, hinges 152 may be attached to inside frame segment 120 via an intermediary mounting bracket such as mounting bracket 158.

Pivoting mullion 140 is shown to include a cam 208 extending upward from an upper surface of top cover 146. Cam 208 may be configured to engage a cam guide 142 to cause rotation of pivoting mullion between the closed position (as shown in FIG. 19) and an open position in which magnets 156 are aligned or substantially aligned with slots 256. Cam guide 142 and the rotation of pivoting mullion 140 are described in greater detail with reference to FIGS. 23-26.

Figure 21:
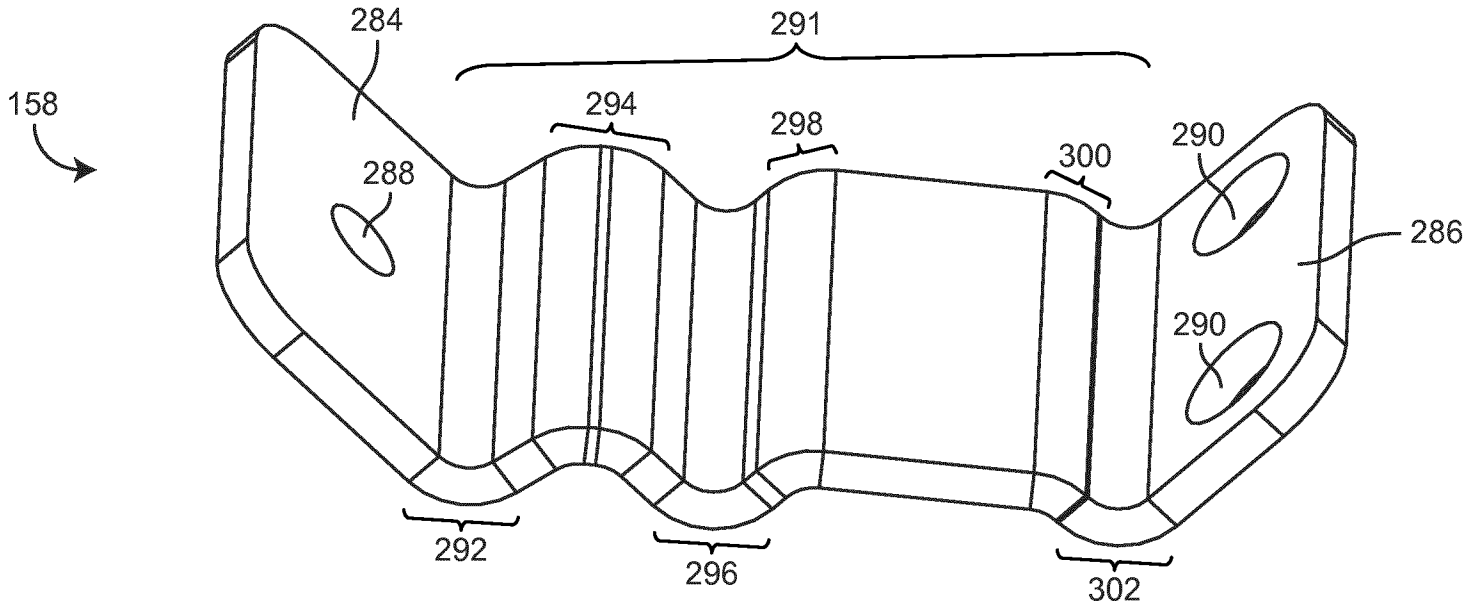
FIGS. 21-22 are drawings illustrating the mounting bracket of FIG. 6 in greater detail, showing the mounting bracket attached to an inward-facing side of a door frame segment, according to an exemplary embodiment.
Figure 22:
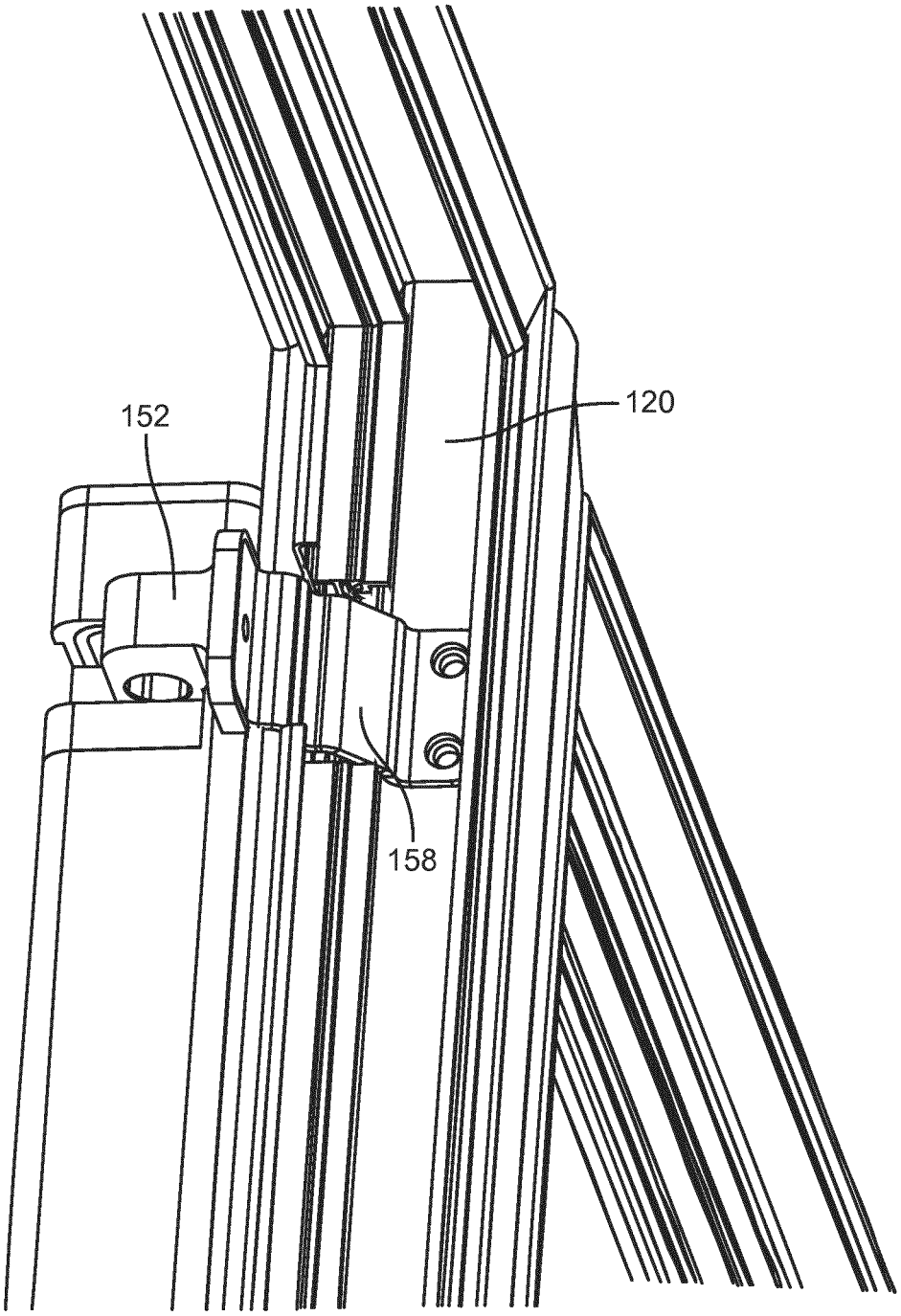

Referring now to FIGS. 21-22, mounting bracket 158 is shown, according to an exemplary embodiment. Mounting bracket 158 may be configured to attach hinges 152 to a frame segment (e.g., frame segment 120) of display case door 102. Mounting bracket 158 is shown to include a first end 284 having a first hole 288, and a second end 286 having second holes 290. First end 284 may be configured to attach to hinge 152 (e.g., by aligning first hole 288 with hole 280 in hinge 152 and securing with a screw, bolt, or other fastener). Second end 286 may be configured to attach to inner frame segment 120 of display case door 102 using second holes 290 and a fastener extending therethrough.

Referring specifically to FIG. 21, first end 284 and second end 286 are shown separated by a middle portion 291. In some embodiments, middle portion 291 is a "L-shaped" segment having a single 90 degree bend. In other embodiments, middle portion 291 includes a plurality of bends. For example, middle portion 291 is shown to include a first bend 292, a second bend 294, a third bend 296, a fourth bend 298, a fifth bend 300, and a sixth bend 302. In various embodiments, and number of bends may be present (e.g., one bend, four bends, eight bends, etc.). In some embodiments, first end 284 and second end 286 may be substantially perpendicular (e.g., oriented at approximately 90 degrees relative to each other).

As shown in FIG. 22, the substantially perpendicular configuration of ends 284 and 286 may be used to attach mounting bracket 158 an inward-facing side of frame segment 120 (e.g., a side of frame segment 120 facing toward other frame segments of display case door 102). Attaching mounting bracket 158 to an inward-facing side of frame segment 120 may be useful for implementations in which it is not feasible or desirable to attach mounting bracket 158 to a rear-facing surface of display case door 102. For example, for implementations in which display case door 102 includes a gasket or other sealing element around a rear perimeter thereof, attaching mounting bracket 158 to a rear-facing surface of frame segment 120 may require altering the gasket, thereby reducing the effectiveness of the seal. As another example, for implementations in which display case door 102 includes a glass panel, additional hardware would likely be required to attach a mounting bracket to the glass panel.

By attaching to an inward-facing surface of frame segment 120, mounting bracket 158 is adapted for use with a display case door for a temperature-controlled storage device. For example mounting bracket 158 may attach to a door having a transparent panel allow items within the temperature-controlled storage device to be viewed without attaching to the transparent panel itself. Additionally mounting bracket 158 may attach to a door having a perimeter seal without affecting or altering the seal. By keeping the seal in an unmodified state, mounting bracket 158 may advantageously reduce the amount of heat transfer through or around display case door 102.

Figure 23:
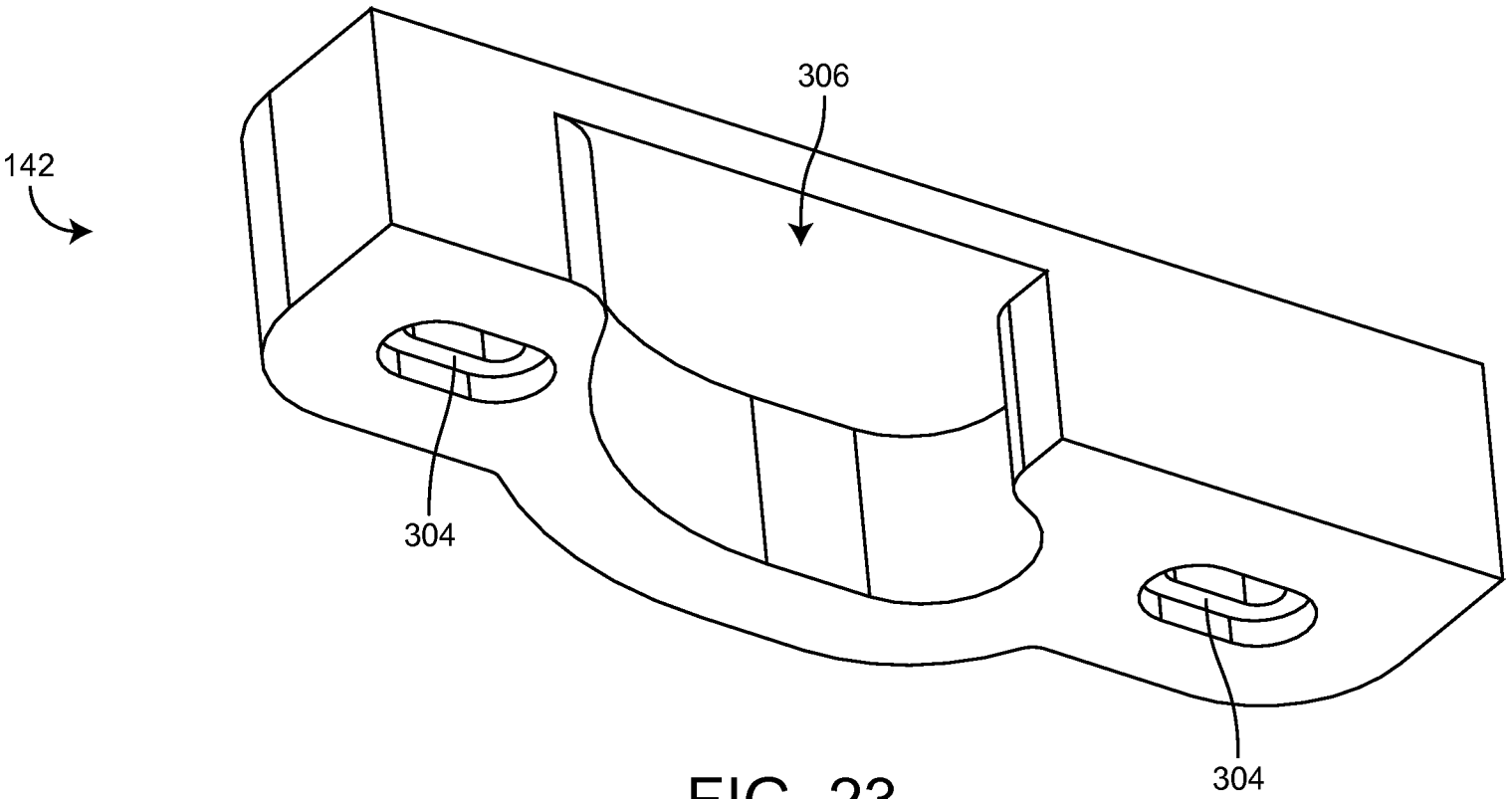
FIG. 23 is a drawing of a cam guide which may be attached to a stationary door frame segment and configured to engage a cam extending from the pivoting mullion for rotating the pivoting mullion between an open position and a closed position, according to an exemplary embodiment.
Figure 24:
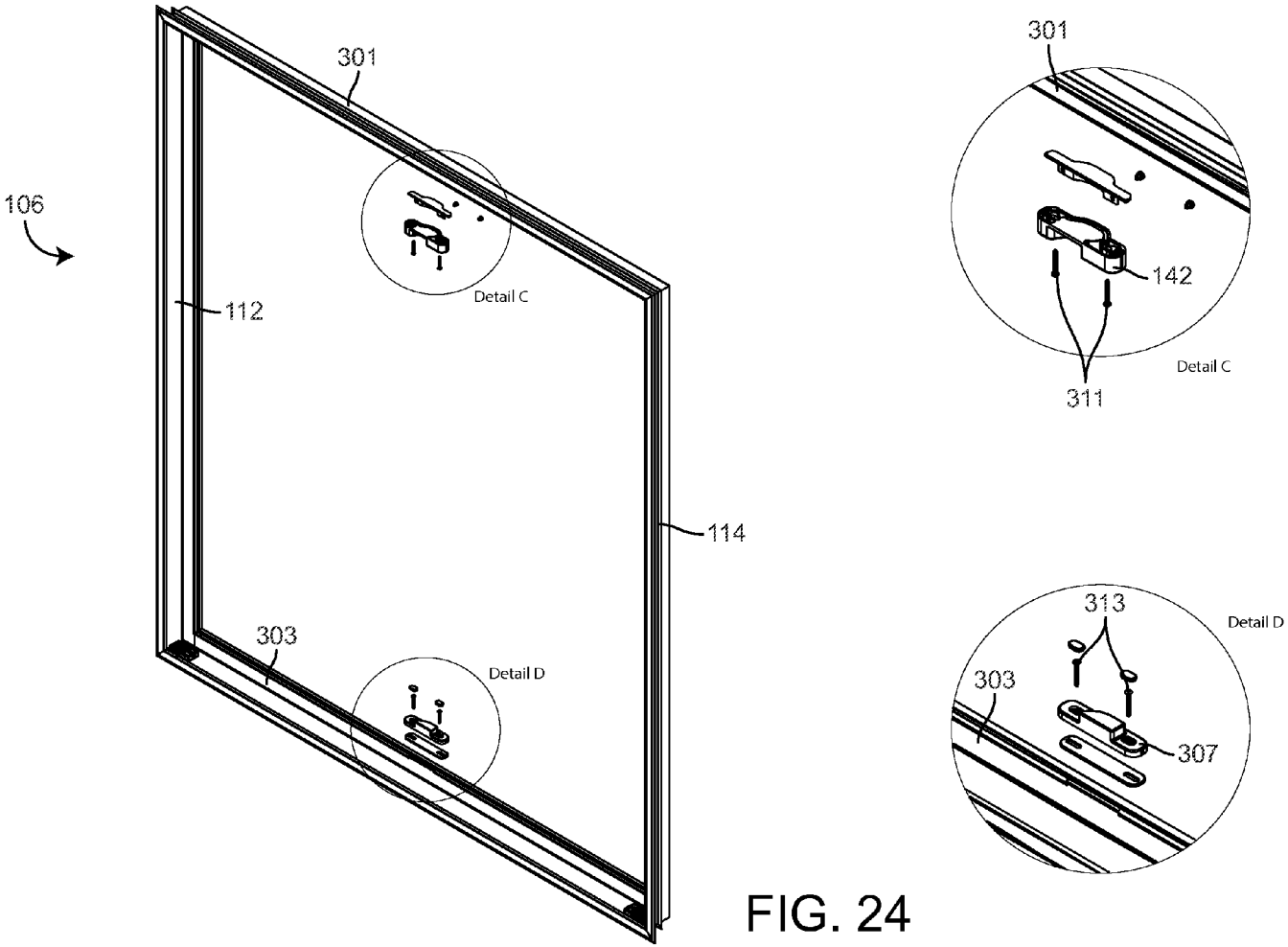
FIG. 24 is a drawing of a door frame for the display case door assembly of FIG. 1 with the cam guide of FIG. 23 secured to a segment of the door frame, according to an exemplary embodiment.

Referring now to FIGS. 23-24, cam guide 142 is shown, according to an exemplary embodiment. Cam guide 142 is shown to include mounting holes 304 and a cam slot 306. Mounting holes 304 may be used to secure cam guide 142 to a stationary frame segment of display case door assembly 100. The frame segment to which cam guide 142 is attached may not move or rotate when display case doors 102 or 104 are opened or closed.

As shown in FIG. 24, cam guide 142 may be fastened to an inward facing surface of door frame 106 (e.g., a surface of door frame 106 facing toward other segments of door frame 106). For example, cam guide 142 may be attached to a lower surface of an upper frame segment 301 of door frame 106. Similarly, cam guide 143 may be attached to an upper surface of a lower frame segment 303 of door frame 106. In some embodiments, cam guide 143 is substantially the same as cam guide 142 (e.g., a mirror image of cam guide 142). In other embodiments, cam guide 143 may be replaced with a cam block 307 configured to engage a corresponding slot in pivoting mullion 140. The slot may replace cam 209 in some embodiments. Cam guides 142-143 may be attached to door frame 106 at or near a horizontal midpoint thereof (e.g., midway between outside frame segments 112 and 114) and secured with fasteners 311 and 313.

Cam slot 306 may be configured to engage cam 208 when display case door 102 is moved into a closed position and to release cam 208 when display case door 102 is moved toward an open position. Cam slot 306 may define a path along which cam 208 is permitted to move while cam 208 is engaged by cam guide 142. In some embodiments, cam 208 may be engaged by cam guide 142 throughout a portion of the rotational range of display case door 102 (e.g., a subset of the complete rotational range, a part of the complete rotational range, less than all of the complete rotational range, etc.). For example, cam 208 may be engaged by cam slot 306 when display case door 102 is in the closed position (e.g., zero degrees open) and throughout a relatively small rotational range between the closed position and the open position (e.g., between 0° open and 10° open, between 0° open and 20° open, between 0° open and θ° open, etc.).

The rotational range of display case door 102 throughout which cam slot 306 engages cam 208 (e.g., 0° open–θ° open) may be referred to as the "engagement range" of display case door 102, where θ is a fixed maximum of the engagement range. In some embodiments, θ can be approximated using the expression $$\tan\theta \approx \frac{w_m}{w_d},$$

where $w_m$ is the width of pivoting mullion 140 (e.g., when pivoting mullion is in the closed position) and $w_d$ is the width of display case door 102.

Advantageously, the path defined by cam slot 306 may cause rotation of pivoting mullion 140 about axis 218 when display case door 102 rotated throughout the engagement range. For example, cam slot 306 may impart a force to cam 208 which is translated into a torque about axis 218. The torque generated by cam slot 306 may be sufficient to overcome the magnetic holding torque or force provided by magnets 156. Accordingly, rotation of display case door 102 throughout the engagement range may cause pivoting mullion 140 to rotate about axis 218. Cam slot 306 may be configured to cause an approximately 90° rotation of pivoting mullion 140 as display case door 102 is rotated through the engagement range.

Figure 25:
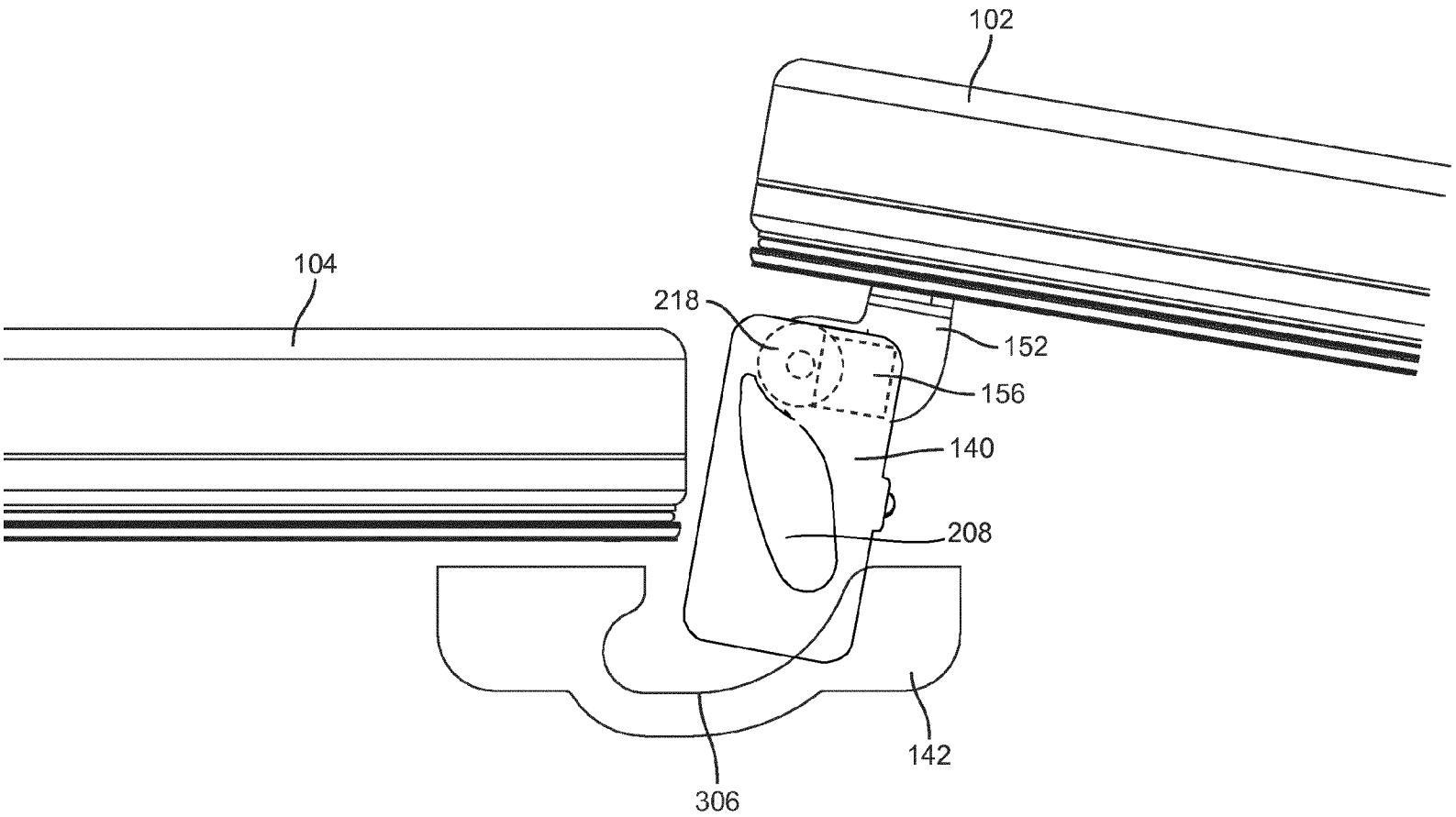
FIGS. 25-27 are drawings illustrating the rotation of the pivoting mullion when engaged by the cam guide of FIG. 23, according to an exemplary embodiment.
Figure 26:
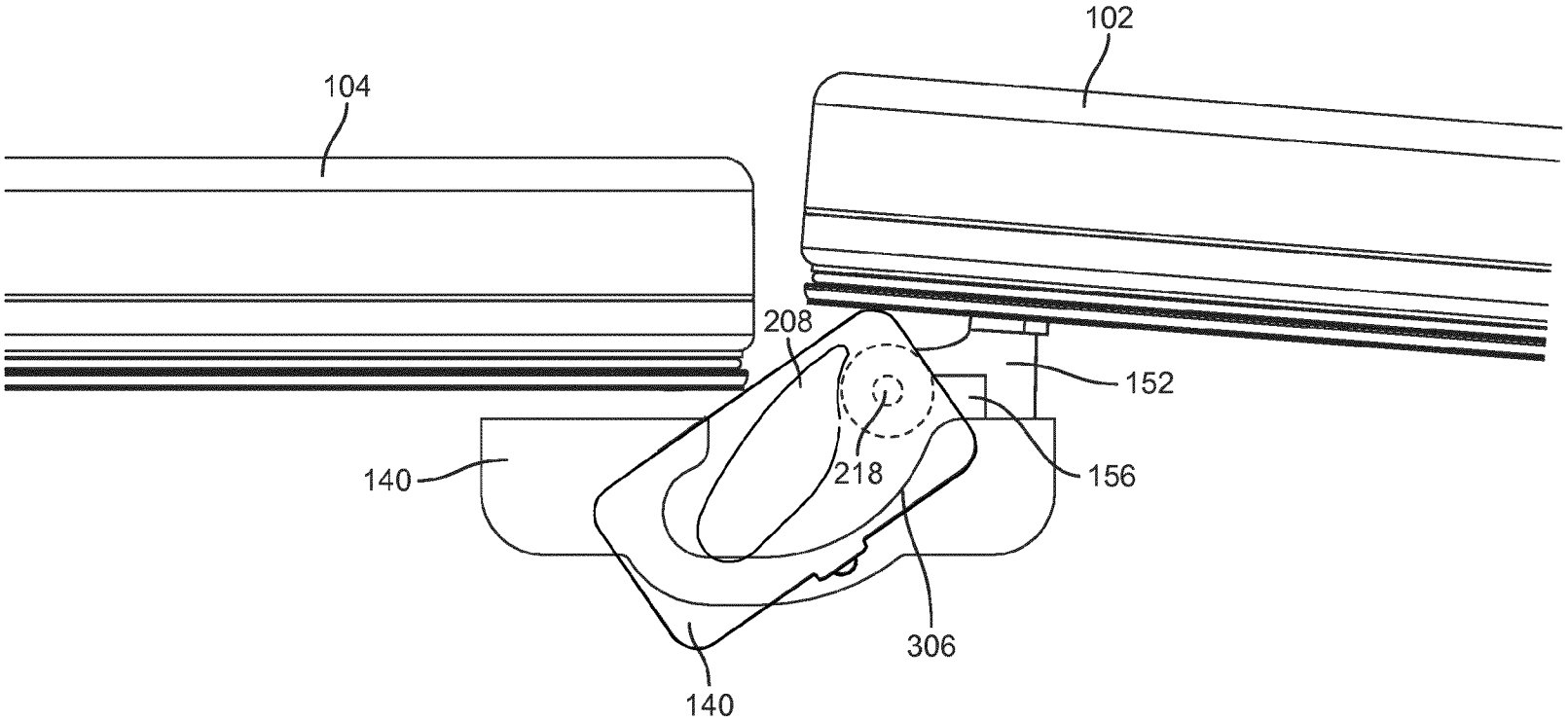
Figure 27:
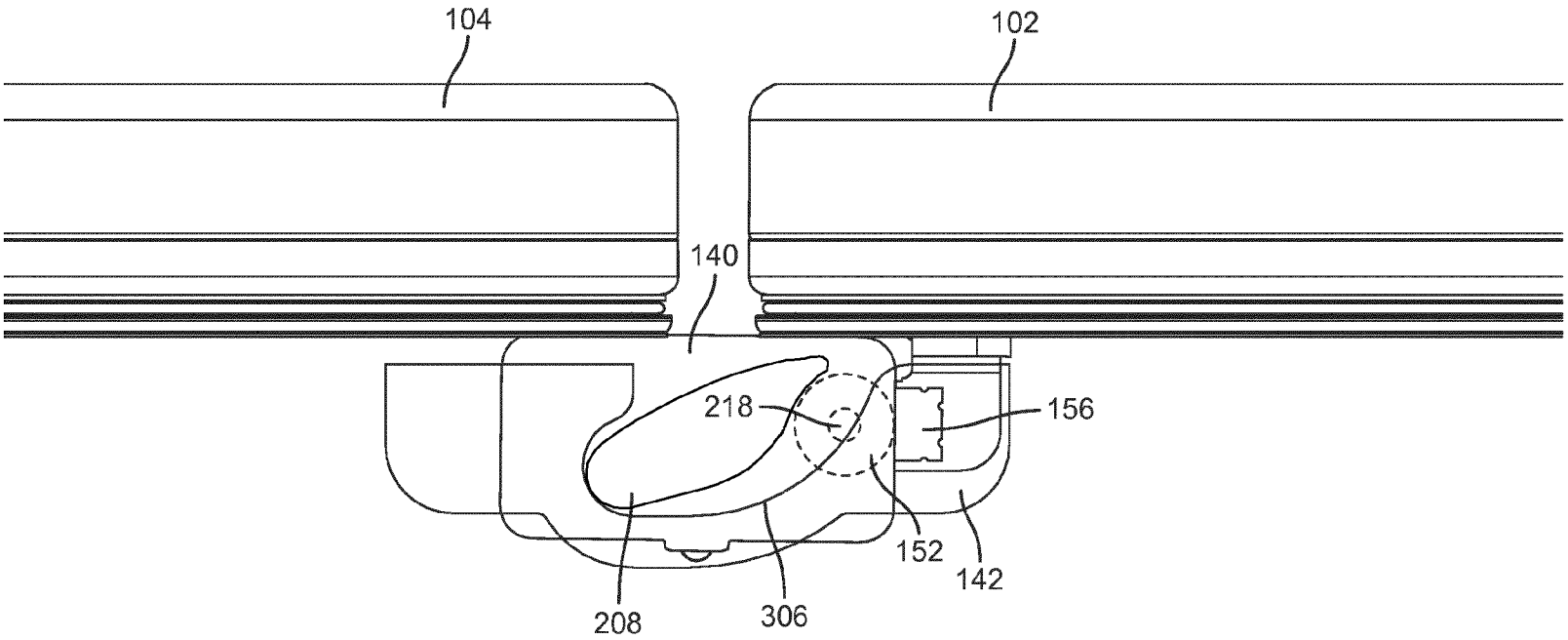

Referring now to FIGS. 25-27 several drawings illustrating the rotation of pivoting mullion 140 are shown, according to an exemplary embodiment. Display case door 102 is shown at various angles of rotation with hinges 152 fixedly attached thereto. Hinges 152 are shown inserted into pivoting mullion 140 such that pin 278 is coaxial with axis 218. As display case door 102 is moved from a partially open position (shown in FIG. 25) to a completely closed position (shown in FIG. 27), cam 208 is engaged by cam slot 306 and pivoting mullion 140 is rotated from the open position (shown in FIG. 25) to the closed position (shown in FIG. 27).

Referring specifically to FIG. 25, display case door 102 is shown at an angle of rotation just exceeding the maximum of the engagement range (e.g., just greater than θ° open). Because display case door 102 is not within the engagement range, cam 208 is not engaged by cam slot 306. However, any further rotation of display case door 102 toward the closed position may cause cam 208 to be engaged by cam slot 306.

In FIG. 25, pivoting mullion 140 is shown in the open position. When pivoting mullion 140 is in the open position, pivoting mullion 140 may not horizontally overlap with display case door 104. This enables display case door 102 to be opened and closed without pivoting mullion 140 contacting display case door 104 or otherwise obstructing the movement of display case door 102. In the open position, pivoting mullion 140 may be oriented substantially perpendicular to display case door 102. Magnets 156 may hold pivoting mullion 140 in the open position while display case door 102 is not within the engagement range (e.g., when the angle or rotation of display case door 102 is greater than θ° open), thereby preventing inadvertent rotation of pivoting mullion 140.

Referring specifically to FIG. 26, display case door 102 is shown at an angle of rotation within the engagement range (e.g., between 0° open and θ° open). Because display case door 102 is within the engagement range, cam 208 is engaged by cam slot 306. As cam 208 is engaged by cam slot 306, cam slot 306 imparts a force upon cam 208. The force imparted upon cam 208 by cam slot 306 causes a torque about axis 218 (e.g., clockwise about axis 218 in FIG. 26) and is sufficient to overcome the holding force/torque provided by magnets 156. As display case door 102 is moved toward a completely closed position, cam 208 continues to move within cam slot 306 (e.g., to the left in FIG. 26) and pivoting mullion 140 is rotated clockwise about axis 218.

Referring specifically to FIG. 27, display case door 102 is shown in a completely closed position (e.g., 0° open). When display case door 102 is in the completely closed position, cam 208 may be at an end of cam slot 306. In FIG. 27, pivoting mullion 140 is shown in the closed position. When pivoting mullion 140 is in the closed position, pivoting mullion 140 may be oriented substantially parallel to display case door 102. In some embodiments, pivoting mullion 140 is rotated by approximately 90° between the open position (shown in FIG. 25) and the closed position (shown in FIG. 27).

As shown in FIG. 27, when pivoting mullion 140 is in the closed position, pivoting mullion 140 may horizontally overlap with display case door 104. This horizontal overlap a central support surface against which display case doors 102 and 104 can rest in a sealed fashion when display case doors 102 and 104 are closed.

Figure 28:
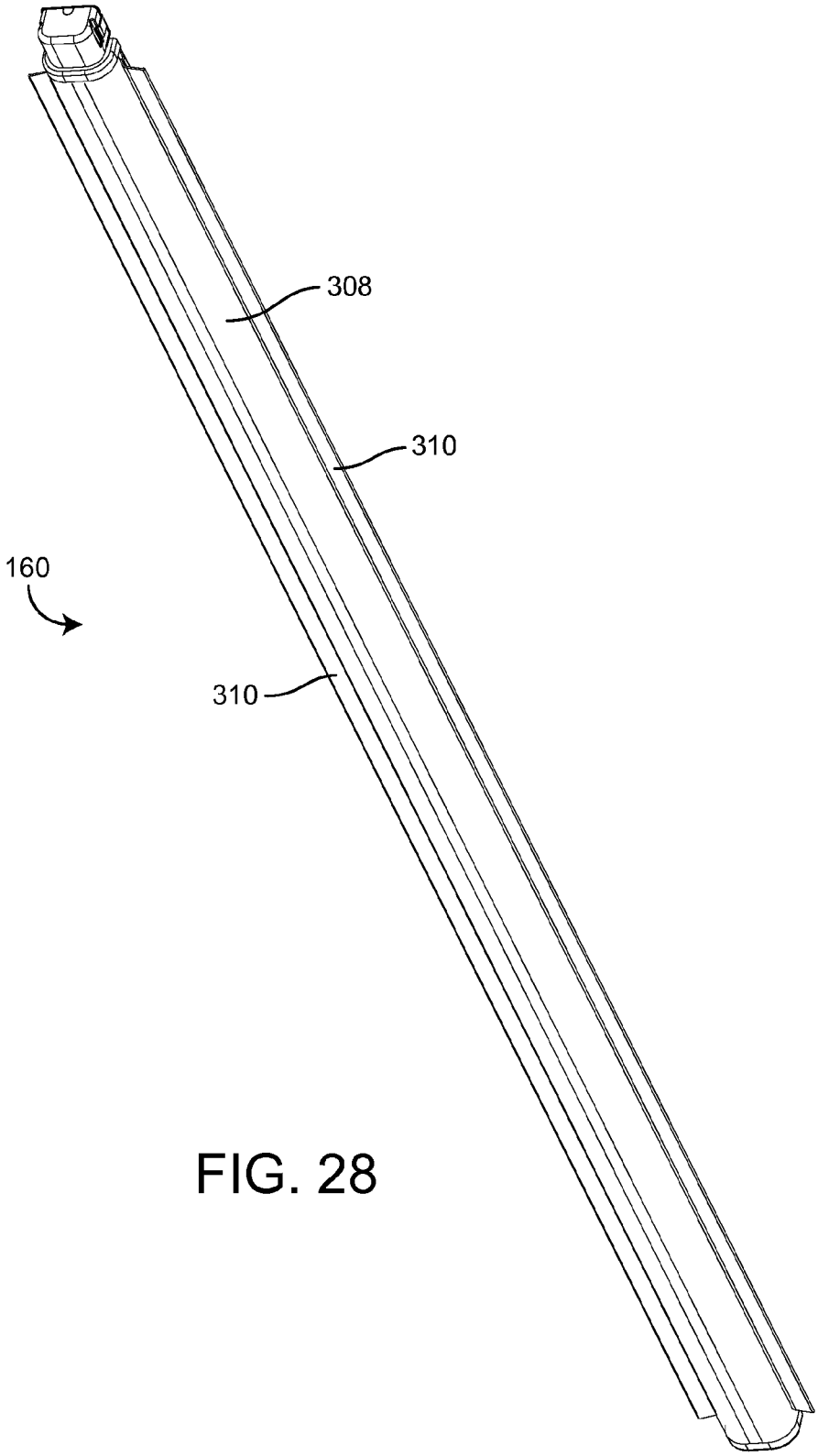
FIGS. 28-29 are drawings illustrating the lighting element of FIG. 6 in greater detail, according to an exemplary embodiment.
Figure 29:
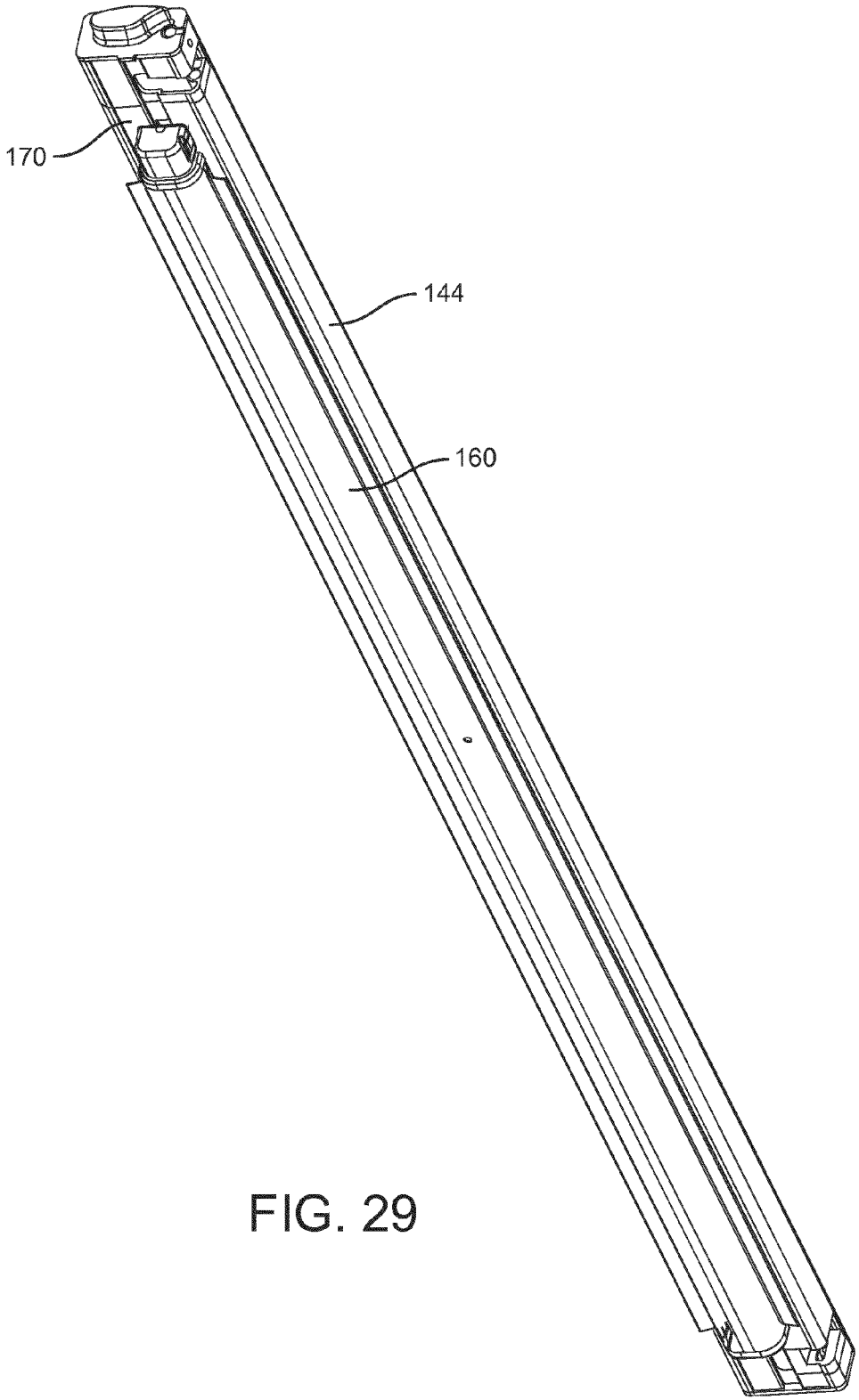

Referring now to FIGS. 28 and 29, lighting element 160 is shown in greater detail, according to an exemplary embodiment. Lighting element 160 is shown to include a light housing 308 and fins 310. Light housing 308 may be a casing, a protective covering, a support structure, or other housing configured to contain and/or support a light. Light housing 308 may contain an incandescent light, a fluorescent light, a halogen light, a light emitting diode (LED), a LED strip, or other element capable of producing light. In some embodiments, light housing 308 is configured to provide electrical connections to the light.

Fins 310 are shown extending horizontally outward from light housing 308. Fins 310 may block the light emitted by lighting element 160 from traveling directly out of the temperature-controlled storage device, thereby providing a more aesthetic visual experience. In some embodiments, fins 310 reflect the light back toward the items in the temperature-controlled storage device (e.g., using a reflective coating, a parabolic shape, an angled surface, etc.).

Referring specifically to FIG. 29, lighting element 160 may be attached to a rear face 170 of mullion body 144 (e.g., fixedly attached using screws or other fasteners). Lighting element 160 may rotate along with mullion body 144 as pivoting mullion 140 rotates about axis 218. Lighting element 160 may move along with pivoting mullion 140 and display case door 102 as display case door 102 is opened and closed.

Advantageously, lighting element 160 may be configured to illuminate when display case door 102 and/or display case door 104 are in a closed position. This configuration allows lighting element 160 to provide lighting for items within the temperature-controlled storage device when display case doors 102 and/or 104 are closed, thereby enabling an observer (e.g., a customer, a user, etc.) to view the items within the temperature-controlled storage device without opening display case doors 102 and/or 104. This configuration may be useful in a supermarket or other setting where it is desirable to view items within the temperature-controlled storage device through a transparent display case door.

In some embodiments, lighting element 160 may be configured to deactivate (e.g. turn off, stop emitting light, etc.) when display case door 102 and/or display case door 104 are opened. In some embodiments, lighting element 160 may be configured to illuminate when pivoting mullion 140 is in the closed position and to turn off when pivoting mullion 140 is not in the closed position. This configuration prevents the light emitted from lighting element 160 from traveling directly out of the temperature-controlled storage device (e.g., and into the eyes of an observer), thereby providing a more aesthetic visual experience. Notably, the configuration provided by lighting element 160 is exactly the opposite of traditional configurations in which a lighting element is activated when a refrigerator or freezer door is opened and deactivated when the door is closed.

The construction and arrangement of the elements of the pivoting mullion as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations.

In the present disclosure, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A pivoting mullion for a temperature-controlled storage device, the pivoting mullion comprising:

a mullion body pivotally attached to a display case door of the temperature-controlled storage device, wherein the mullion body is configured to rotate relative to the display case door between a first position when the display case door is opened and a second position when the display case door is closed, wherein the mullion body is configured to provide a support surface against which the display case door rests when the display case door is closed; and a lighting element fixed to the mullion body and configured to activate when the display case door is closed and deactivate when the display case door is open such that the lighting element emits light when the display case door is closed and does not emit light when the display case door is open, wherein activation of the lighting element illuminates items within the temperature-controlled storage device such that the items are visible through a substantially transparent surface of the display case door when the display case door is closed.

2. The pivoting mullion of claim 1, further comprising:

a cam extending from the mullion body; and a cam guide attached to a frame of the temperature-controlled storage device, wherein the cam guide is configured to engage the cam when the display case door is moved toward a closed position, wherein engaging the cam causes the mullion body to rotate toward the second position.

3. The pivoting mullion of claim 2, wherein the cam guide is configured to engage the cam throughout an engagement range, wherein the engagement range is a portion of a complete rotational range of the display case door.

4. The pivoting mullion of claim 1, further comprising:

a magnetic coupling configured to bias the mullion body toward the first position and to hold the mullion body in the first position when the display case door is open.

5. The pivoting mullion of claim 1, wherein the mullion body comprises:

an extruded shell; and an insulating foam core within the extruded shell.

6. The pivoting mullion of claim 1, further comprising a hinge fixedly attached to the display case door, the hinge comprising:

a transverse portion extending substantially horizontally away from the display case door; and a pin extending substantially vertically from the transverse portion, the pin defining an axis of rotation within the mullion body about which the mullion body rotates between the first position and the second position.

7. The pivoting mullion of claim 1, wherein the mullion body is substantially rectangular comprising a first face and a second face substantially perpendicular to the first face, wherein the first face and the second face share an edge;

wherein the mullion body includes a continuous opening spanning a portion of the first face, a portion of the shared edge, and a portion of the second face.

8. The pivoting mullion of claim 7, further comprising a hinge fixedly attached to the display case door, the hinge comprising a transverse portion extending substantially horizontally through the continuous opening in the mullion body, wherein the transverse portion extends through the portion of the opening in the first face when the mullion body is in the first position, and wherein the transverse portion extends through the portion of the opening in the second face when the mullion body is in the second position.

9. A pivoting mullion for a temperature-controlled storage device, the pivoting mullion comprising:

a mullion body pivotally attached to a door of the temperature-controlled storage device, wherein the mullion body is configured to rotate between a first position and a second position relative to the door, wherein the mullion body is configured to provide a support surface against which the door rests when the mullion body is in the second position and the door is closed;

a hinge fixedly attached to the door and comprising a transverse portion extending substantially horizontally through an opening in a horizontal-facing surface of the mullion body, the transverse portion comprising a magnet housed therein; and an insert located within the mullion body and vertically offset from the transverse portion of the hinge, wherein the insert is configured to rotate into vertical alignment with the magnet when the mullion body is rotated into the first position and to rotate out of vertical alignment with the magnet when the mullion body is rotated into the second position;

wherein the magnet is configured to apply a magnetic force vertically between the hinge and the insert, the magnetic force biasing the mullion body toward the first position and holding the mullion body in the first position when the door is open.

10. The pivoting mullion of claim 9, wherein the hinge further comprises a pin extending substantially vertically from the transverse portion, the pin defining an axis of rotation within the mullion body about which the mullion body rotates between the first position and the second position.

11. The pivoting mullion of claim 9, wherein the door is a display case door for a temperature-controlled display case.

12. The pivoting mullion of claim 9, further comprising:

a cam extending from the mullion body; and a cam guide attached to a frame of the door, wherein the cam guide is configured to engage the cam when the door is moved toward a closed position, wherein engaging the cam causes the mullion body to rotate toward the second position.

13. The pivoting mullion of claim 9, wherein the mullion body rotates approximately 90 degrees between the first position and the second position.

14. The pivoting mullion of claim 9, wherein the mullion body comprises:

an extruded shell; and an insulating foam core within the extruded shell.

15. A pivoting mullion for a temperature-controlled storage device, the pivoting mullion comprising:

a mullion body comprising an extruded shell and an insulating foam core within the extruded shell, wherein the mullion body is pivotally attached to a door of the temperature-controlled storage device and configured to rotate between a first position and a second position relative to the door, wherein the mullion body is configured to provide a support surface against which the door rests when the mullion body is in the second position and the door is closed, a hinge fixedly attached to the door and comprising a transverse portion extending suhstantially horizontally through an opening in the mullion body, the transverse portion comprising a magnet housed therein; and an insert located within the mullion body and vertically offset from the transverse portion of the hinge, wherein the insert is configured to rotate into vertical alignment with the maunet when the mullion body is rotated into the first position and to rotate out of vertical alignment with the magnet when the mullion body is rotated into the second position;

wherein the magnet is configured to apply a magnetic force vertically between the hinge and the insert, the magnetic force biasing the mullion body toward the first position and holding the mullion body in the first position when the door is open.

16. The pivoting mullion of claim 15, further comprising:

a cam extending from the mullion body; and a cam guide attached to a frame of the door, wherein the cam guide is configured to engage the cam when the door is moved toward a closed position, wherein engaging the cam causes the mullion body to rotate toward the second position.

17. The pivoting mullion of claim 15, wherein the hinge further comprises a pin extending substantially vertically from the transverse portion, the pin defining an axis of rotation within the mullion body about which the mullion body rotates between the first position and the second position.

18. The pivoting mullion of claim 15, wherein the door is a display case door for a temperature-controlled display case, the display case door comprising an insulated glass panel.

19. The pivoting mullion of claim 15, wherein the hinge is pivotally attached to the mullion body;

the pivoting mullion further comprising a mounting bracket having a first end attached to the hinge and a second end attached to an inward-facing surface of a frame segment of the door, wherein the mullion body is pivotally attached to the door via the hinge and the mounting bracket, wherein the mounting bracket is configured to attach to a display case door having an insulated glass panel.

20. A pivoting mullion for a temperature-controlled storage device, the pivoting mullion comprising:

a mullion body pivotally attached to a door of the temperature-controlled storage device and configured to move along with the door between an open position and a closed position, wherein the mullion body comprises a substantially planar surface against which the door rests in the closed position;

a fixture attached to a door frame of the temperature-controlled storage device and configured to engage the mullion body when the door is moved between the open position and the closed position, wherein engaging the mullion body causes the substantially planar surface to rotate relative to the door;

a hinge fixedly attached to the door and comprising a transverse portion extending substantially horizontally through an opening in a horizontal-facing surface of the mullion body, the transverse portion comprising a magnet housed therein, and an insert located within the mullion body and vertically offset from the transverse portion of the hinge, wherein the insert is configured to rotate into vertical alignment with the magnet when the mullion body is rotated into a first position and to rotate out of vertical alignment with the magnet when the mullion body is rotated into a second position;

wherein the magnet is configured to apply a magnetic force vertically between the hinge and the insert, the magnetic force biasing the mullion body toward the first position and holding the mullion body in the first position when the door is in the open position.

21. The pivoting mullion of claim 20, further comprising:

a cam projecting substantially vertically from the mullion body;

wherein the fixture comprises a cam guide attached to the door frame and configured to engage the cam when the door is moved between the open position and the closed position.

22. The pivoting mullion of claim 20, wherein the fixture comprises a cam projecting substantially vertically from the door frame and configured to engage the mullion body when the door is moved between the open position and the closed position.

23. The pivoting mullion of claim 20, further comprising:

a pin inserted into the mullion body and defining an axis of rotation within a perimeter of the mullion body about which the mullion body rotates relative to the door.

24. The pivoting mullion of claim 20, wherein engaging the mullion body causes the mullion body to rotate relative to the door between:

the first position in which the substantially planar surface is substantially aligned with a side surface of the door; and the second position in which the substantially planar surface is substantially aligned with a rear surface of the door and substantially perpendicular to the side surface of the door.

25. A temperature-controlled storage device comprising:

a temperature-controlled space;

a door frame defining an opening into the temperature-controlled space;

a first door movable relative to the door frame between an open position and a closed position;

a fixture coupled to the door frame;

a pivoting mullion rotatably attached to the first door and configured to engage the fixture when the first door is moved between the open position and the closed position, wherein engaging the fixture causes the pivoting mullion to rotate relative to the first door;

a hinge fixedly attached to the first door and comprising a transverse portion extending substantially horizontally through an opening in the pivoting mullion, the transverse portion comprising a magnet housed therein; and an insert located within the pivoting mullion and vertically offset from the transverse portion of the hinge, wherein the insert is configured to rotate into vertical alignment with the magnet when the pivotinu mullion is rotated into a first position and to rotate out of vertical alignment with the magnet when the pivoting mullion is rotated into a second position;

wherein the magnet is configured to apply a magnetic force vertically between the hinge and the insert, the magnetic force biasing the pivoting mullion toward the first position and holding the pivoting mullion in the first position when the first door is in the open position.

26. The temperature-controlled storage device of claim 25, further comprising:

a second door movable relative to the door frame between an open position and a closed position;

wherein the pivoting mullion provides a support surface against which both the first door and the second door rest in the closed position.

27. The temperature-controlled storage device of claim 26, wherein the first door moves within a first space and the second door moves within a second space separate from and adjacent to the first space, wherein the first space and the second space are bounded by a substantially vertical plane between the first door and the second door;

wherein rotating the pivoting mullion relative to the first door causes the pivoting mullion to extend through the substantially vertical plane as the first door is moved into the closed position.

28. The temperature-controlled storage device of claim 25, wherein the pivoting mullion comprises:

a mullion body configured to provide a support surface against which the first door rests when the first door is in the closed position;

wherein engaging the fixture causes the support surface to rotate into alignment with the first door when the first door is moved into the closed position.

29. The temperature-controlled storage device of claim 25, wherein moving the first door between the open position and the closed position comprises rotating the first door relative to the door frame about an axis of rotation adjacent to a first edge of the first door;

wherein the pivoting mullion is pivotally attached to the first door along a second edge of the first door opposite the first edge.

30. The temperature-controlled storage device of claim 25, wherein moving the first door between the open position and the closed position comprises rotating the first door in a first direction of rotation relative to the door frame;

wherein rotating the first door in a first direction of rotation relative to the door frame causes the pivoting mullion to rotate relative to the door in a second direction of rotation opposite the first direction of rotation.

* * * * *